US007501593B2

(12) United States Patent
Brojanac

(10) Patent No.: US 7,501,593 B2
(45) Date of Patent: Mar. 10, 2009

(54) SWITCH LOCKOUT DEVICE

(75) Inventor: Michael Brojanac, Jackson, WI (US)

(73) Assignee: Master Lock Company LLC, Oak Creek, WI (US)

( * ) Notice: Subject to any disclaimer, the term of this patent is extended or adjusted under 35 U.S.C. 154(b) by 0 days.

(21) Appl. No.: 11/856,493

(22) Filed: Sep. 17, 2007

(65) Prior Publication Data

US 2008/0067043 A1 Mar. 20, 2008

Related U.S. Application Data

(60) Provisional application No. 60/845,355, filed on Sep. 18, 2006.

(51) Int. Cl.
*H01H 9/28* (2006.01)

(52) U.S. Cl. ..... 200/43.14; 200/43.15

(58) Field of Classification Search ..... 200/43.01, 200/43.11, 43.14, 43.15, 43.16, 43.19, 43.21
See application file for complete search history.

(56) References Cited

U.S. PATENT DOCUMENTS

| | | | |
|---|---|---|---|
| 1,983,902 | A | 12/1934 | Hanny |
| 2,169,860 | A | 8/1939 | Von Hoorn |
| 2,192,060 | A | 2/1940 | Wise |
| 2,849,552 | A | 8/1958 | Firestone |
| 2,943,162 | A | 6/1960 | Norden |
| 2,978,613 | A | 4/1961 | Hein |
| 2,983,799 | A | 5/1961 | Osieja et al. |
| 3,076,876 | A | 2/1963 | Stanback et al. |
| 3,214,530 | A | 10/1965 | Tharp et al. |
| 3,255,320 | A | 6/1966 | Norden |
| 3,288,954 | A | 11/1966 | Norden |
| 3,291,924 | A | 12/1966 | Tharp |
| 3,312,794 | A | 4/1967 | Hollyday |
| 3,376,400 | A | 4/1968 | Batt et al. |
| 3,388,224 | A | 6/1968 | Higgins |
| 3,408,466 | A | 10/1968 | Palmer |
| 3,426,164 | A | 2/1969 | Dessert |
| 3,470,336 | A | 9/1969 | De Angelo |
| 3,566,326 | A | 2/1971 | Middendorf et al. |
| 3,595,040 | A | 7/1971 | Curl |
| 3,649,784 | A | 3/1972 | Middendorf et al. |
| 3,678,228 | A | 7/1972 | Adamson |
| 4,006,324 | A | 2/1977 | Leasher et al. |

(Continued)

OTHER PUBLICATIONS

International Search Report for PCT Application No. PCT/US07/78647, mailed Sep. 26, 2008.

*Primary Examiner*—Michael A Friedhofer
(74) *Attorney, Agent, or Firm*—Calfee, Halter & Griswold LLP

(57) ABSTRACT

A lockout device for a switch assembly includes a body and first and second laterally extending pins and a cam member assembled with the body. The laterally extending pins are laterally movable between hole engaging and hole disengaging positions. The cam member is pivotable with respect to the body between locking and unlocked positions. When the cam member is in the locking position, the cam member holds the first and second pins in the hole engaging position. When the cam member is in the unlocked position, the first and second pins are movable from the hole engaging position to the hole disengaging position. The body defines a lock opening configured to receive a lock member to secure the cam member in the locking position.

21 Claims, 20 Drawing Sheets

U.S. PATENT DOCUMENTS 4,160,137 A 7/1979 Clement et al.
4,260,861 A 4/1981 DiMarco
4,347,412 A 8/1982 Mihara et al.
4,467,152 A 8/1984 Gordy
4,491,897 A 1/1985 Troebel
4,554,421 A 11/1985 Grunert et al.
4,677,261 A 6/1987 Nourry
4,733,029 A 3/1988 Kobayashi et al.
4,882,456 A 11/1989 Hovanic et al.
4,897,515 A 1/1990 Zubar et al.
4,978,816 A 12/1990 Castonguay et al.
5,079,390 A 1/1992 Costanzo et al.
5,113,043 A 5/1992 Morris
5,122,624 A 6/1992 Benda
5,147,991 A 9/1992 Jordan, Sr.
5,148,910 A 9/1992 Williams
5,165,528 A 11/1992 Kozlowski et al.
5,181,602 A 1/1993 Kozlowski et al.
5,207,315 A 5/1993 Benda
5,219,070 A 6/1993 Grunert et al.
5,225,963 A 7/1993 Smart
5,256,838 A 10/1993 Benda
5,260,528 A 11/1993 Benda
5,270,503 A 12/1993 Frye
5,290,979 A * 3/1994 Grass ..... 200/43.19
5,300,740 A 4/1994 Benda
5,310,969 A 5/1994 Turek et al.
5,322,980 A 6/1994 Benda
5,324,897 A 6/1994 Melgoza et al.
5,349,145 A 9/1994 Kelaita, Jr. et al.
5,357,070 A 10/1994 Parsons, Jr.
5,449,867 A 9/1995 Kelaita, Jr. et al.
5,467,622 A 11/1995 Becker et al.
5,468,925 A 11/1995 Mohsen
5,477,016 A 12/1995 Baginski et al.
5,500,495 A 3/1996 Benda et al.
5,504,284 A 4/1996 Lazareth et al.
5,521,344 A 5/1996 De Leo
5,543,593 A 8/1996 Turek
5,558,209 A 9/1996 Mohsen
5,577,599 A 11/1996 Turek et al.
5,593,020 A 1/1997 Alexander
5,610,375 A 3/1997 Sinthomez
5,663,862 A 9/1997 Hopping-Mills
5,732,815 A 3/1998 Brouwer
5,772,007 A 6/1998 Frye
5,782,341 A 7/1998 Calder et al.
5,794,760 A 8/1998 Alexander
5,817,998 A 10/1998 Siebels et al.
5,817,999 A 10/1998 Mugan et al.
5,844,186 A 12/1998 Meriwether
5,900,600 A 5/1999 Alexander et al.
5,905,236 A 5/1999 Green
5,909,019 A 6/1999 Maloney et al.
5,954,191 A 9/1999 Reiter
6,015,956 A 1/2000 Green
6,388,213 B1 5/2002 Letient et al.
6,396,008 B1 5/2002 Maloney et al.
6,469,264 B2 10/2002 Benda
6,563,063 B1 5/2003 Moore
6,617,532 B1 9/2003 Turek
6,649,851 B1 * 11/2003 Hennel et al. ..... 200/43.14
6,680,445 B1 1/2004 Oravetz et al.
6,696,651 B1 2/2004 Koopmeiners et al.
6,703,572 B1 * 3/2004 Broghammer ..... 200/43.14
6,727,441 B2 4/2004 Benda
6,791,040 B1 9/2004 Puhalla et al.
6,844,512 B2 * 1/2005 Benda ..... 200/43.14
7,262,376 B2 * 8/2007 Brojanac et al. ..... 200/43.14
2002/0139646 A1 10/2002 Karlicek
2004/0099514 A1 5/2004 McCoy
2004/0245077 A1 12/2004 Benda
2006/0070861 A1 4/2006 Bogdon et al.

* cited by examiner

SWITCH LOCKOUT DEVICE

CROSS REFERENCE TO RELATED APPLICATION

This application claims the benefit of U.S. Patent Application Ser. No. 60/845,355, entitled "SWITCH LOCKOUT DEVICE" and filed Sep. 18, 2006, the entire contents of which are incorporated herein by reference, to the extent that they are not conflicting with the present application.

BACKGROUND

Many switches, such as, for example, circuit breaker switches, are designed to be switched between two positions (for example, an "on" position and an "off" position) with minimal force. Additionally, a circuit breaker switch may be configured to reset certain functions of the circuit breaker when the switch is toggled to the "on" position. Switches are commonly designed to offer little resistance to position change. In application, this feature makes switches easy to use and operate. However, in some conditions, the low resistance of switches to position change can create several concerns. Accidental, innocent or unauthorized switch position changes can cause safety hazards, damage equipment or cause lost production time and/or in-process material losses.

SUMMARY

The present application describes devices and methods which may be utilized for preventing unauthorized or accidental movement of a switch, for example, between first and second toggle positions. In one embodiment, a lockout device is configured to be used with a switch assembly having a switch laterally disposed between first and second side walls having holes aligned to receive one or more obstructions to hold the lever in one of the first and second toggle positions. While many different types of obstructions may be utilized, in one embodiment, a lockout device includes first and second laterally extending pins laterally movable between a hole engaging position, in which the pins are inserted through the side wall holes, and a hole disengaging position, in which the pins are withdrawn from the side wall holes. The lockout device includes a locking arrangement to secure the pins in a hole engaging position for obstructing movement of the switch. While many different locking arrangements may be utilized, in one embodiment, a lockout device includes a body defining a lock opening configured to receive a lock member, such as, for example, a padlock shackle, to prevent movement of the pins from the hole engaging position to the hole disengaging position.

Accordingly, in one exemplary embodiment, a lockout device for a switch assembly includes a body, with first and second laterally extending pins and a cam member assembled with the body. The laterally extending pins are laterally movable between hole engaging and hole disengaging positions. The cam member is pivotable with respect to the body between locking and unlocked positions. When the cam member is in the locking position, the cam member holds the first and second pins in the hole engaging position. When the cam member is in the unlocked position, the first and second pins are movable from the hole engaging position to the hole disengaging position. The body defines a lock opening configured to receive a lock member to secure the cam member in the locking position.

BRIEF DESCRIPTION OF THE DRAWINGS

Features and advantages of the invention will become apparent from the following detailed description made with reference to the accompanying drawings, wherein.

DETAILED DESCRIPTION OF THE INVENTION

The Detailed Description of the Invention merely describes preferred embodiments of the invention and is not intended to limit the scope of the disclosure in any way. Indeed, the invention as described by the specification is broader than and unlimited by the preferred embodiments, and the terms in the specification have their full ordinary meaning.

Figure 1:
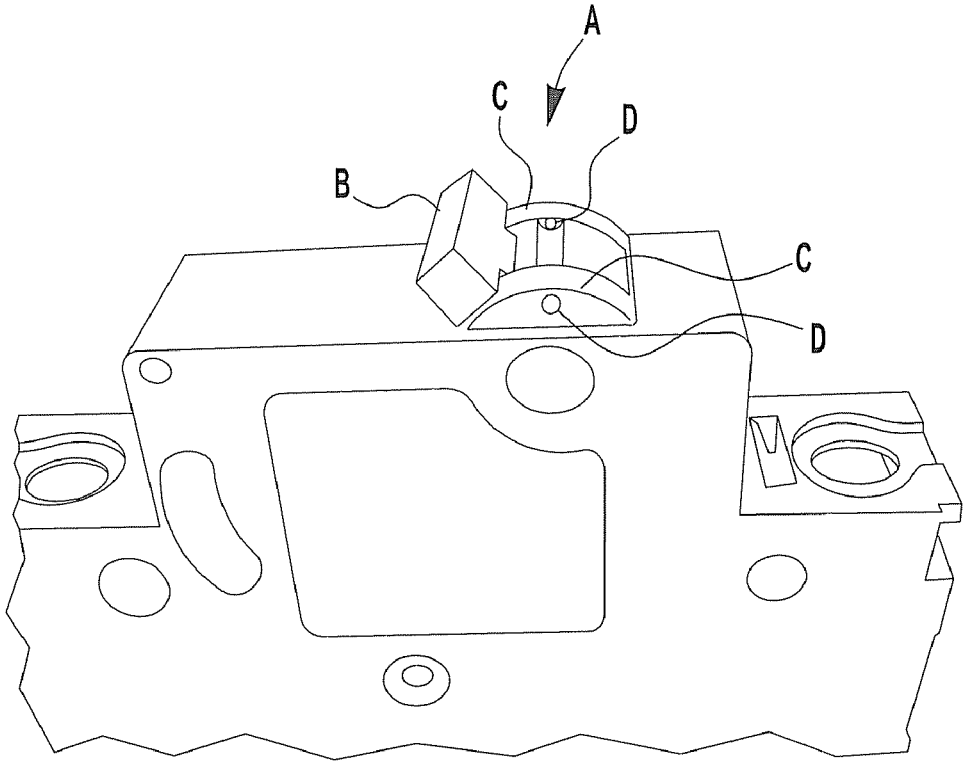
FIG. 1 is a schematic perspective view of an ISO-DIN circuit breaker switch assembly.

According to an inventive aspect of the present application, a lockout device is provided for a switch assembly having a lever or toggle switch movable between first and second toggle positions, the lever switch being laterally disposed between first and second parallel side walls having locking holes aligned to receive one or more obstructions to hold the lever in one of the first and second toggle positions. One such type of circuit breaker switch that is commonly used in Europe and Asia is an ISO-DIN type circuit breaker switch, which is dimensioned and configured in accordance with ISO and DIN standards. The ISO-DIN switch assembly A, as shown in FIG. 1, includes a paddle-type lever switch B laterally disposed between parallel side walls C. The side walls of the exemplary switch assembly A include aligned holes D positioned to receive obstructions, such as, for example, laterally extending pins, for preventing movement of the switch B from the current position to the opposite position.

In one embodiment, a lockout device includes first and second laterally extending locking pins movable from a hole disengaging position, in which the locking pins are retracted or withdrawn from the side wall holes D, to a hole engaging position, in which the locking pins are inserted through the side wall holes D, such that a portion of the lockout device, such as, for example, the pins, obstructs movement of the switch B from a first position to a second position. The lockout device further includes a cam member configured to move between a locking position and an unlocked position. When the cam member is in the locking position, the cam member holds the first and second pins in the hole engaging position. The exemplary lockout device also includes a lock opening configured to receive a locking member for securing the cam member in the locking position.

Figure 2A:
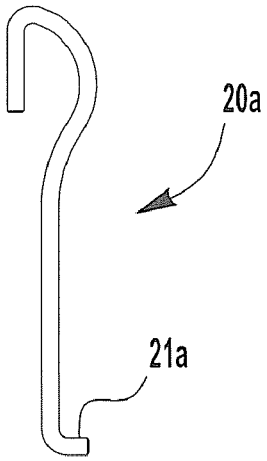
FIGS. 2A-2F are side and perspective views of various pin components for use with a switch lockout device.
Figure 2B:
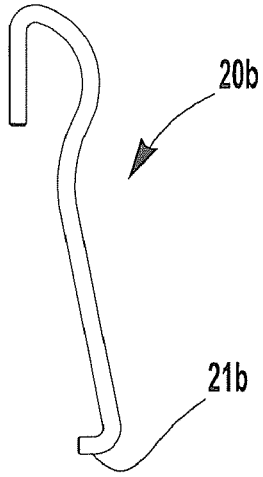
Figure 2C:
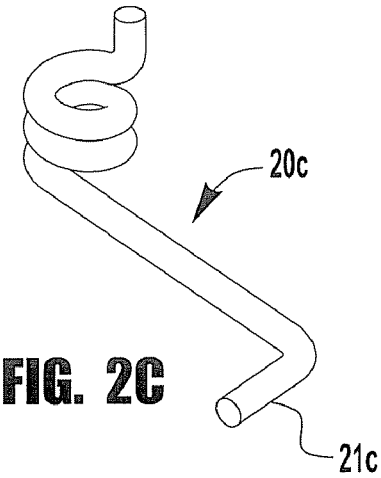
Figure 2D:
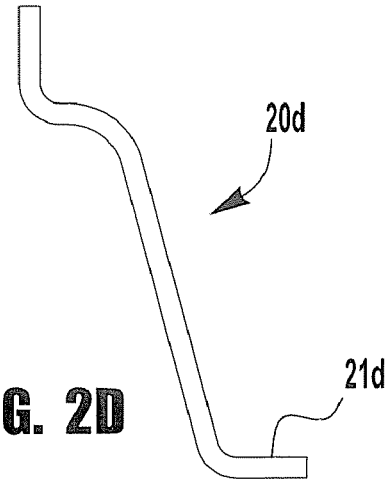
Figure 2E:
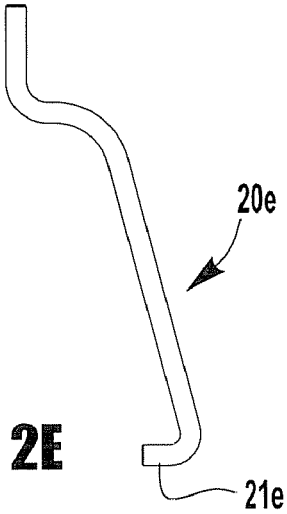
Figure 2F:
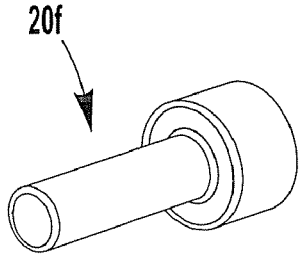
Figure 3A:
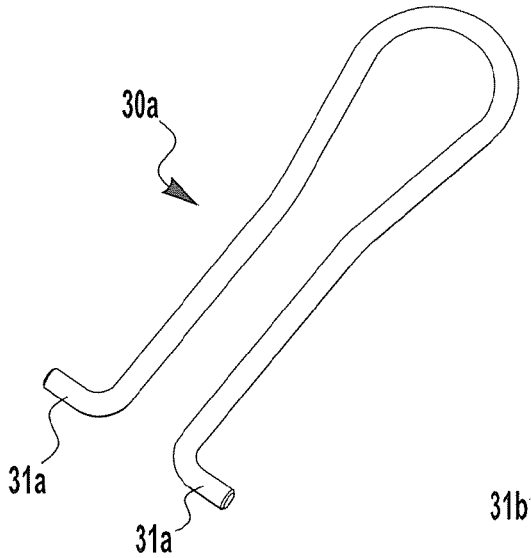
FIGS. 3A-3B are perspective views of spring members including laterally extending pins.
Figure 3B:
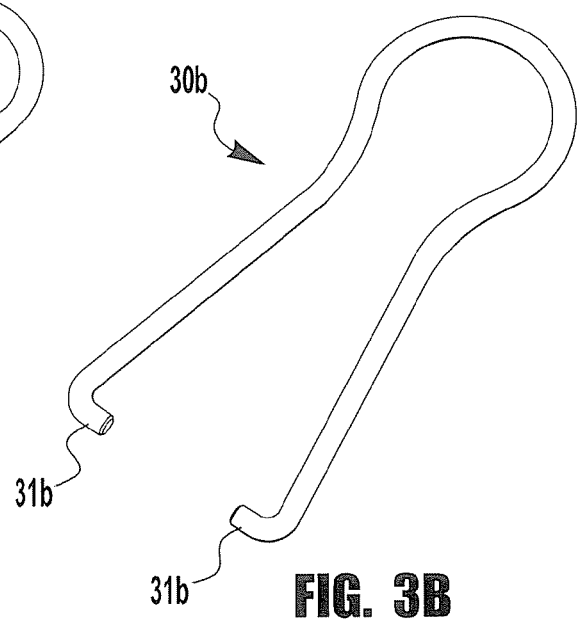

Many different types of locking pins may be provided with a switch lockout device for insertion into the locking holes of the switch assembly. In one embodiment, the locking pins may be disposed on resilient spring pin components that may be biased into engagement with the locking holes and return or "spring" back to an unbiased condition when the biasing force is removed, thereby disengaging from the locking holes. Examples of such locking pin components 20*a*-20*e* are illustrated in FIGS. 2A-2E, respectively, and include laterally extending pins 21*a*-21*e* for engaging the side wall holes of a switch assembly. In another embodiment, as shown in FIG. 2F, a non-resilient or rigid pin component 20*f* may (but need not) be used with an associated spring or other such cam member (not shown) to provide biased engagement with a side wall hole. To engage both side wall holes of a switch assembly, a lockout device may include two such pins 20*a*-20*f* in symmetrically opposite orientations. In still other embodiments, as shown in FIGS. 3A and 3B, pins 31*a*, 31*b* may be disposed at the ends of generally U-shaped spring members 30*a*, 30*b*, thereby providing first and second laterally extending pins in a single component. The pins may extend laterally outward (shown for example in FIG. 3A), such that the pins engage the locking holes from between the side walls (thereby requiring laterally inward movement to disengage the pins 31*a* from the corresponding side wall holes), as shown, for example, in the embodiment of FIGS. 4-8. Alternatively, the pins may extend laterally inward (shown for example in FIG. 3B), such that the pins engage the locking holes from outside the side walls (thereby requiring laterally outward movement to disengage the pins 31*b* from the corresponding side wall holes), as shown, for example, in the embodiment of FIG. 15. As used herein, pins extend "laterally" when they extend at least partially toward the side walls of a switch assembly when the associated lockout device is aligned with the switch assembly. In other embodiments (not shown), a switch lockout device may be configured to engage only one of the locking holes, while still obstructing movement of the lever switch to effect a lockout.

Many different types of cam members may be provided with a switch lockout device to limit movement of the locking pins into or out of engagement with the side wall holes. In one embodiment, a cam member may be assembled with a body of a lockout device such that the cam member is pivotable from a pin disengaging or unlocked position to a pin engaging or locking position.

Figure 4:
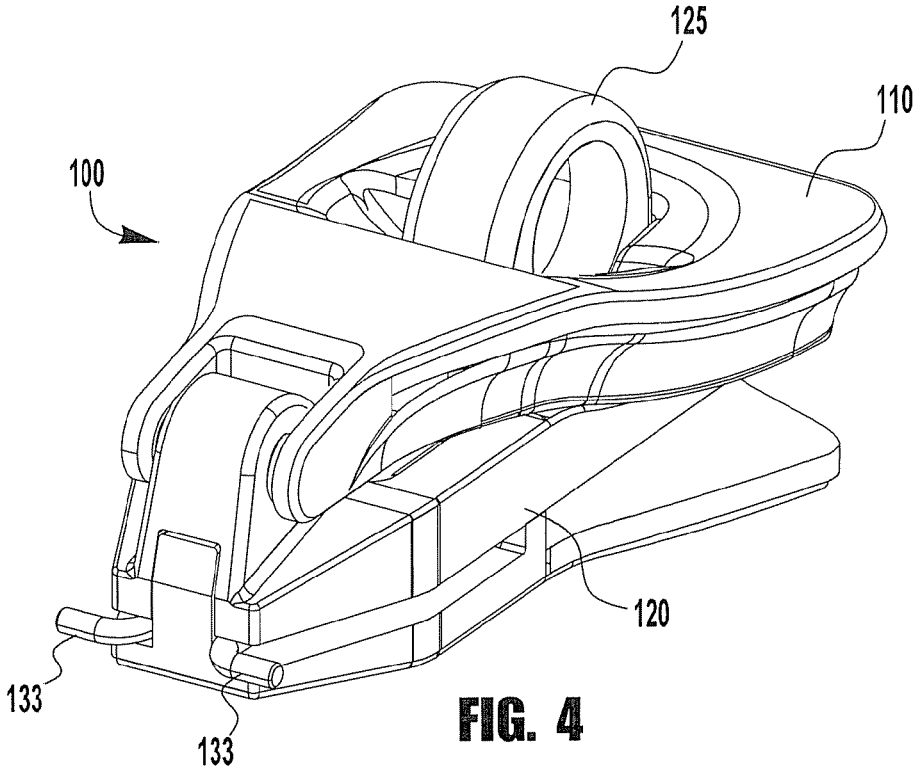
FIG. 4 is a perspective view of a switch lockout device, shown in a locking position.

FIGS. 4-8 illustrate an exemplary lockout device 100 having a pivotable cam member or lever 110 assembled with a body 120 and configured to be pivotable between an unlocked or pin disengaging position (FIGS. 6 and 7) and a locking or pin engaging position (FIG. 4). The cam member 110 includes a camming portion or post 112 that is received in a corresponding opening 122 in the body 120 when the cam member 110 is in the locking position. In the locking position, the post 112 engages side portions 135 of a spring member 130 retained within the body 120 to force the laterally extending pins 133 outward and into engagement with the side wall holes of a switch assembly (for example, the switch assembly A of FIG. 1) when the lockout device 100 is aligned with the switch assembly.

While many different locking arrangements may be used to secure the can member 110 in the locking position, in the illustrated embodiment, a hasp portion 125 defining a lock opening 126 extends from the body 120 through a corresponding opening or slot 115 in the cam member 110. Insertion of a lock member (for example, a padlock shackle, not shown) through the lock opening 126 prevents movement of the cam member 110 out of the locking position, thereby securing the pins 133 in the hole engaging position. To remove the lockout device 100 from the associated switch assembly, the lock member is removed from the lock opening 126 to allow the cam member 110 to be pivoted out of the locking position to the unlocked position.

Figure 5:
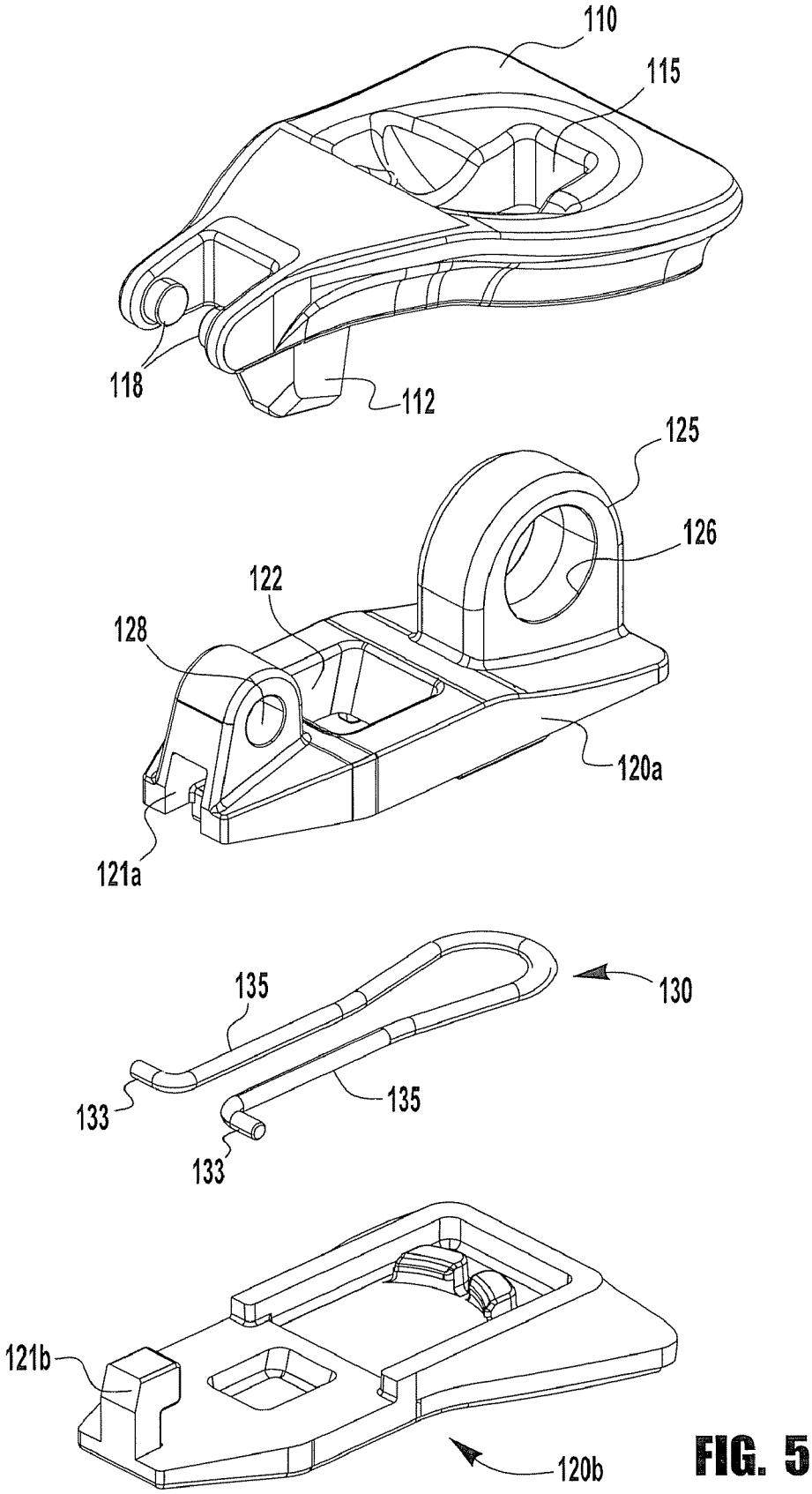
FIG. 5 is an exploded perspective view of the switch lockout device of FIG. 4.
Figure 6:
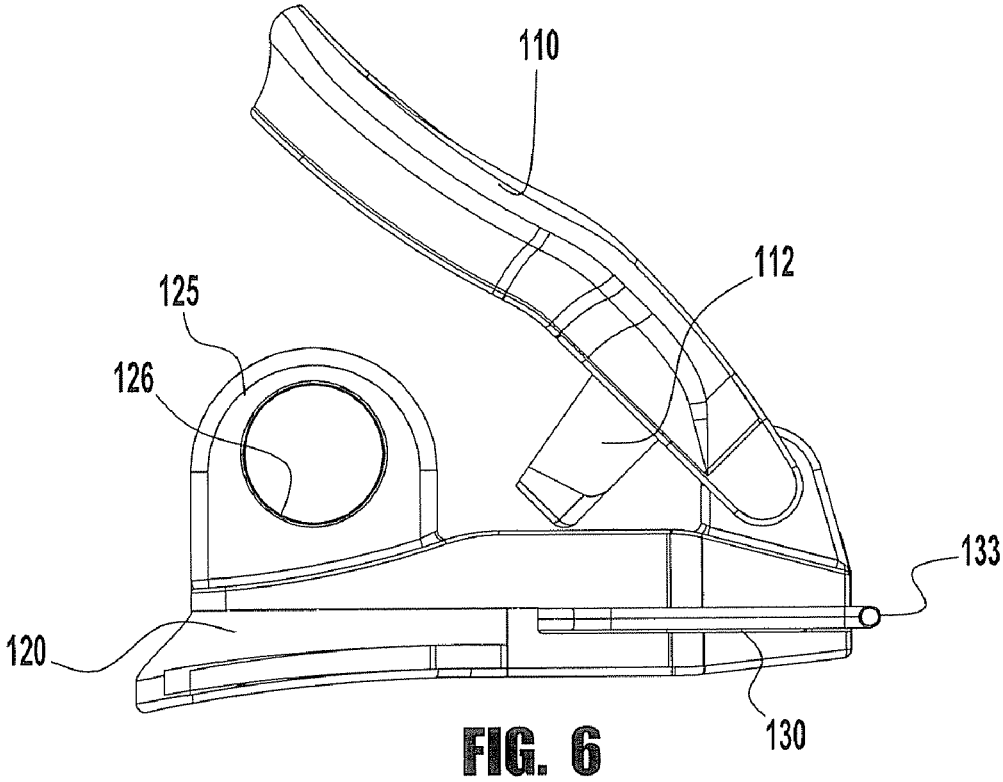
FIG. 6 is a side view of the switch lockout device of FIG. 4.
Figure 7:
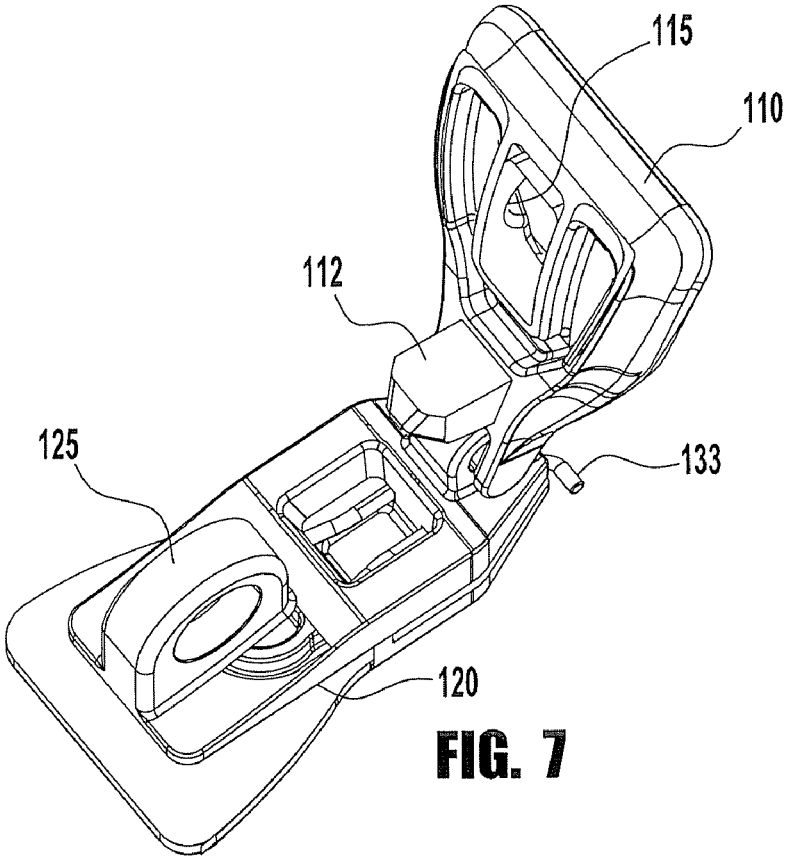
FIG. 7 is a perspective view of the switch lockout device of FIG. 4 in an unlocked position.
Figure 8:
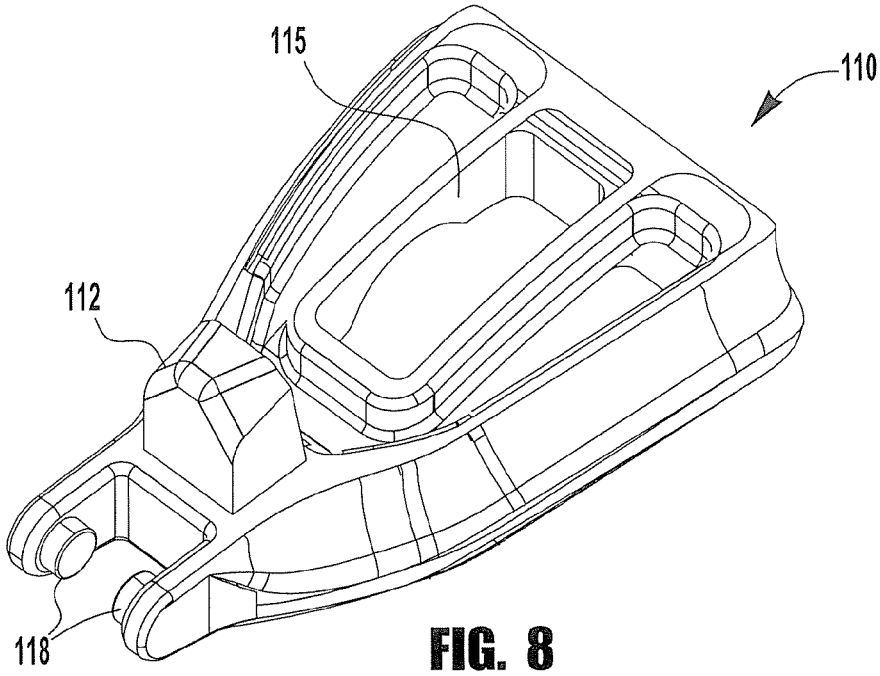
FIG. 8 is a bottom perspective view of the cam member of the switch lockout device of FIG. 4.
Figure 9:
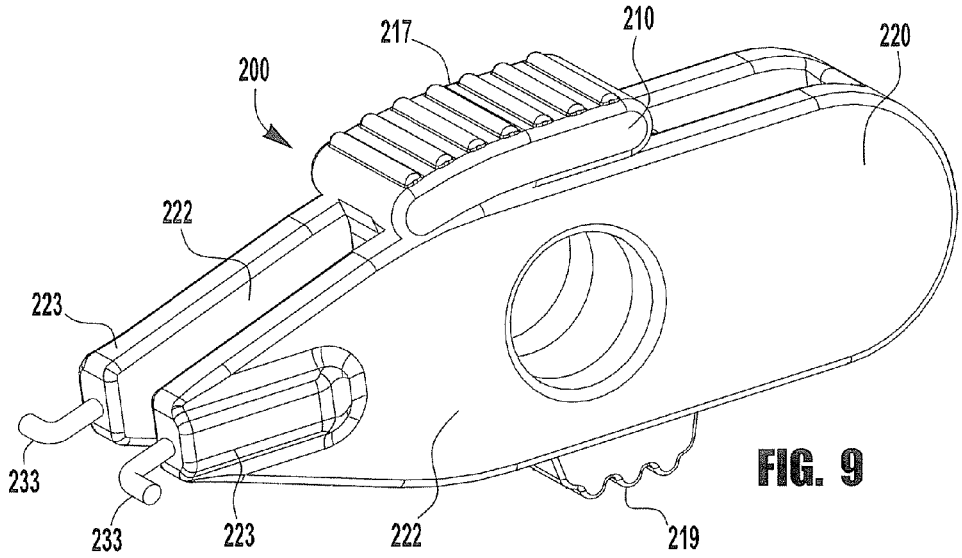
FIG. 9 is a perspective view of still another switch lockout device, shown in a locking position.
Figure 10:
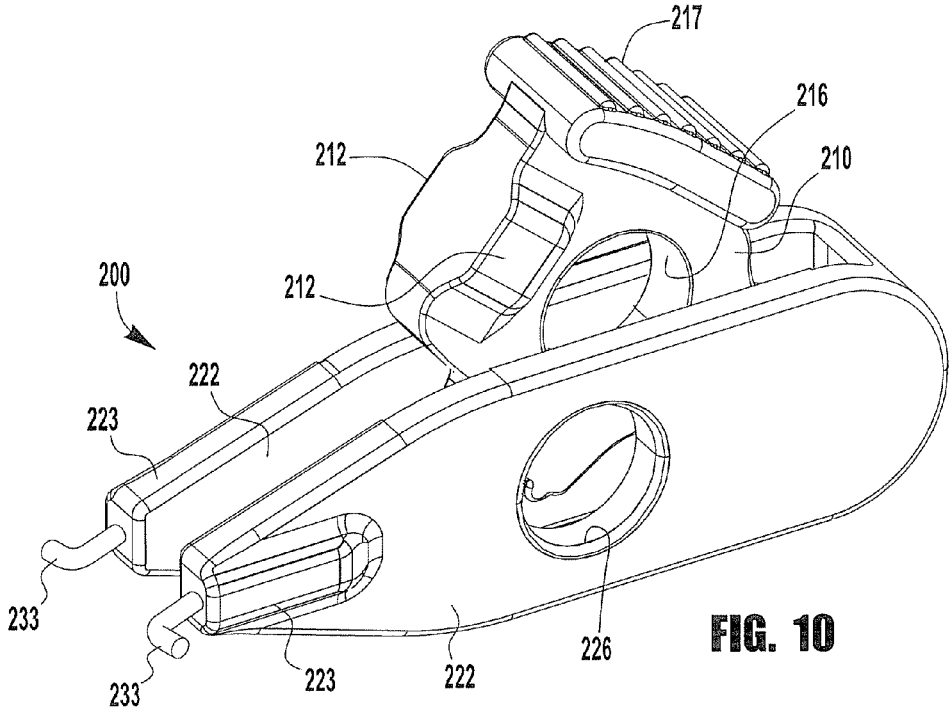
FIG. 10 is a perspective view of the switch lockout device of FIG. 9 in an unlocked position.
Figure 11:
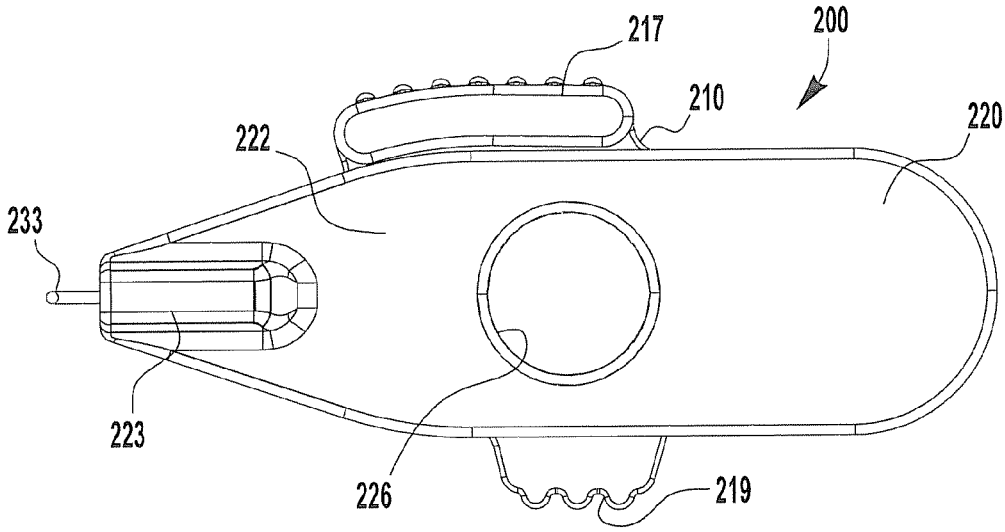
FIG. 11 is a side view of the switch lockout device of FIG. 9 in the locking position.
Figure 12:
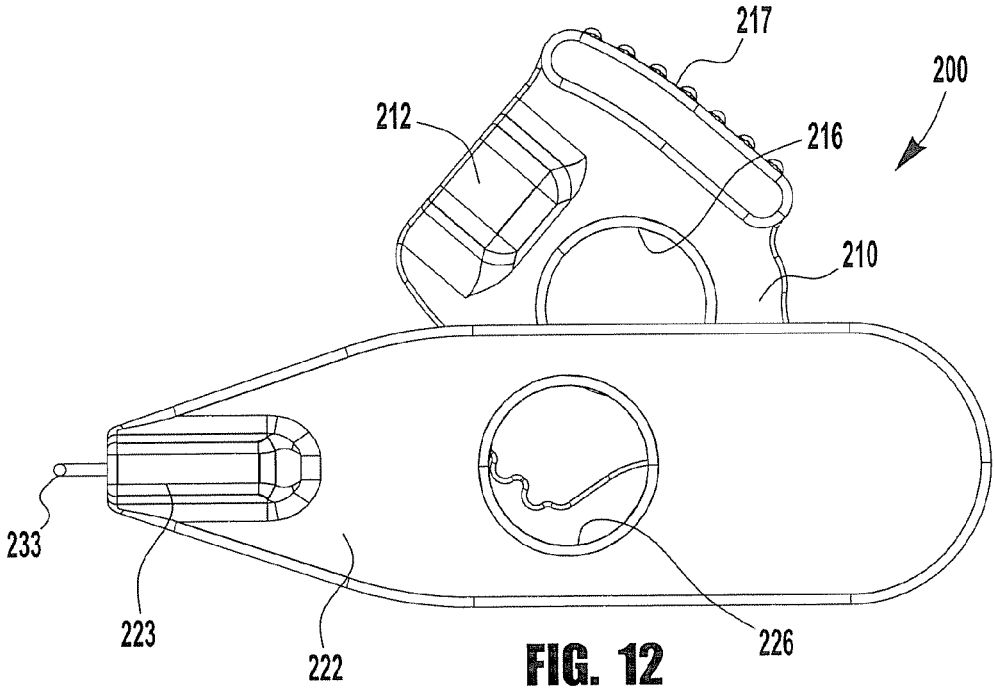
FIG. 12 is a side view of the switch lockout device of FIG. 9 in the unlocked position.

While the body 120 may be provided in many different configurations, in the illustrated embodiment, the body 120 includes upper and lower portions 120*a*, 120*b* (see FIG. 5) that may be assembled together to enclose the spring member 130 while allowing the pins 133 to extend from the body 120. Many different assembly methods may be used, such as, for example, fasteners, adhesives, or welding. In the illustrated embodiment, a tab 121*b* on the lower body portion 120*b* snaps into engagement with a corresponding notch 121*a* in the upper body portion. Also, while the cam member 110 may be collected with the body 120 using many different configurations, in the illustrated embodiment, the illustrated cam member 110 includes opposed nubs 118 (see FIG. 8) that snap into and pivot within a corresponding hole 128 (see FIG. 5) of the body 120. As shown in FIGS. 4 and 5, the cam member 110 may be contoured to facilitate user grasping and manipulation.

Figure 14:
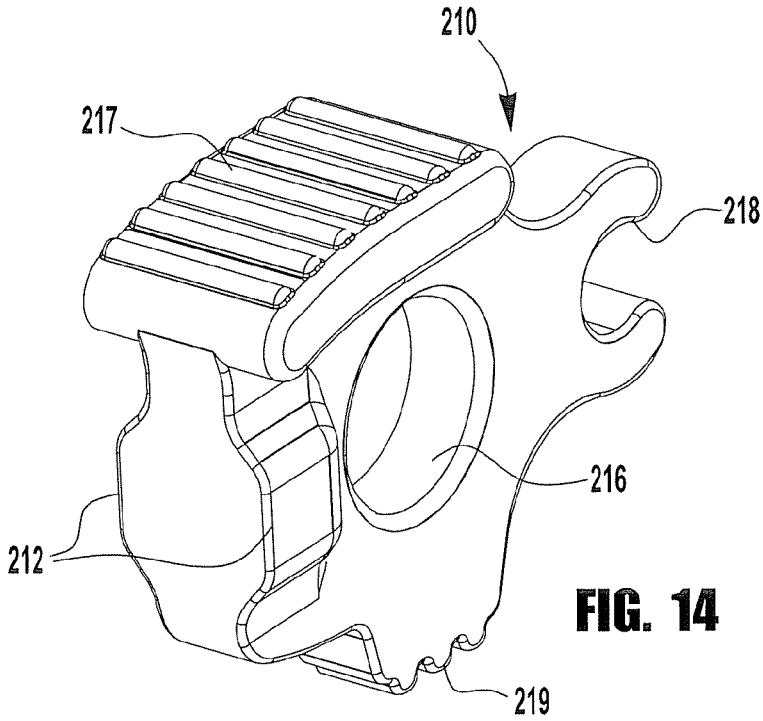
FIG. 14 is a side perspective view of the cam lever of the switch lockout device of FIG. 9.
Figure 14A:
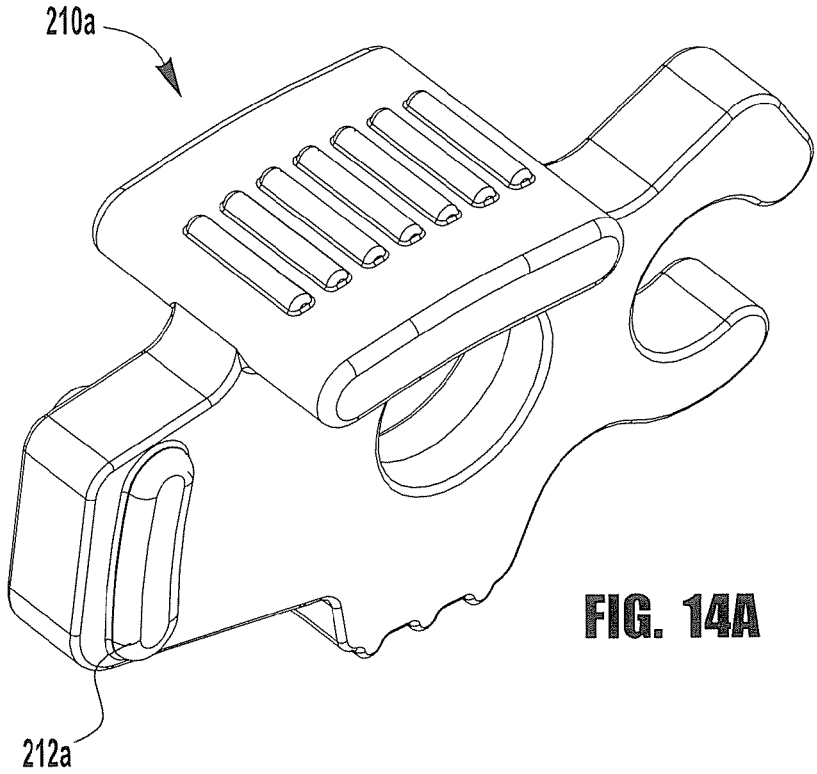
Figure 14B:
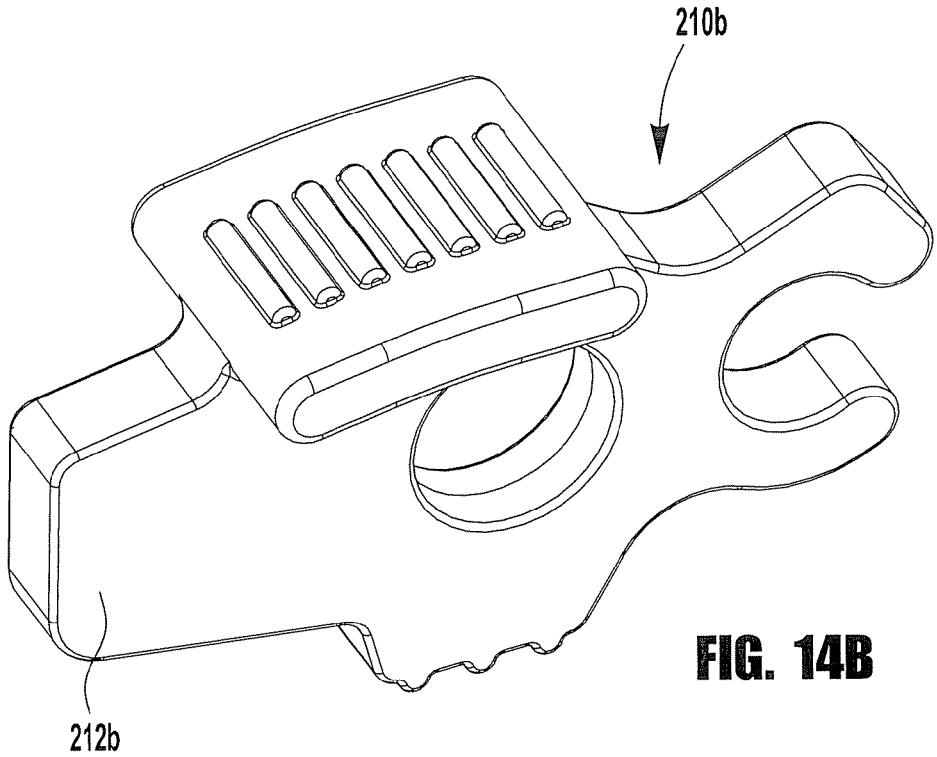

In another embodiment, a cam member may include a lock opening that aligns with one or more lock openings in a body when the cam member is pivoted to a locking position, such that insertion of a lock member in the aligned lock openings prevents movement of the cam member from the locking position to the unlocked position. FIGS. 9-12 illustrate one such lockout device 200 having a cam member 210 assembled between side walls 222 of a body 220 and pivotable between a locking position (shown in FIGS. 9 and 11) and an unlocked position (shown in FIGS. 10 and 12). Laterally extending pins 233 extend from end portions 223 of side walls 222. The cam member 210 includes side camming portions or protrusions 212 that hold the pins 233 in a laterally outward hole engaging position when the cam member 210 is in the locking position. Other types of protrusions 212 may be used, as shown, for example, on the cam member 210*a* of FIG. 14A, which includes thinner camming portions 212*a*. While the camming portions 212 may apply outward camming forces directly to the pins 233, as shown in the embodiment of FIGS. 4-8, in the embodiment of FIGS. 9-12, the camming portions 212 engage the body side walls 222, causing the side walls to flex outward, thereby extending the pins 233 to the hole engaging position. In this position, a lock opening 216 in the cam member 210 aligns with lock openings 226 in the side walls 222 of the body 220, such that insertion of a lock member (not shown) secures the cam member 210 in the locking position. In other embodiments, as shown in FIG. 14B, the camming portions 212*b* may be flat surfaces which, instead of flexing the side walls 222 outward, merely prevent the side walls 222 and pins 233 from being squeezed into a hole disengaging position.

Figure 13:
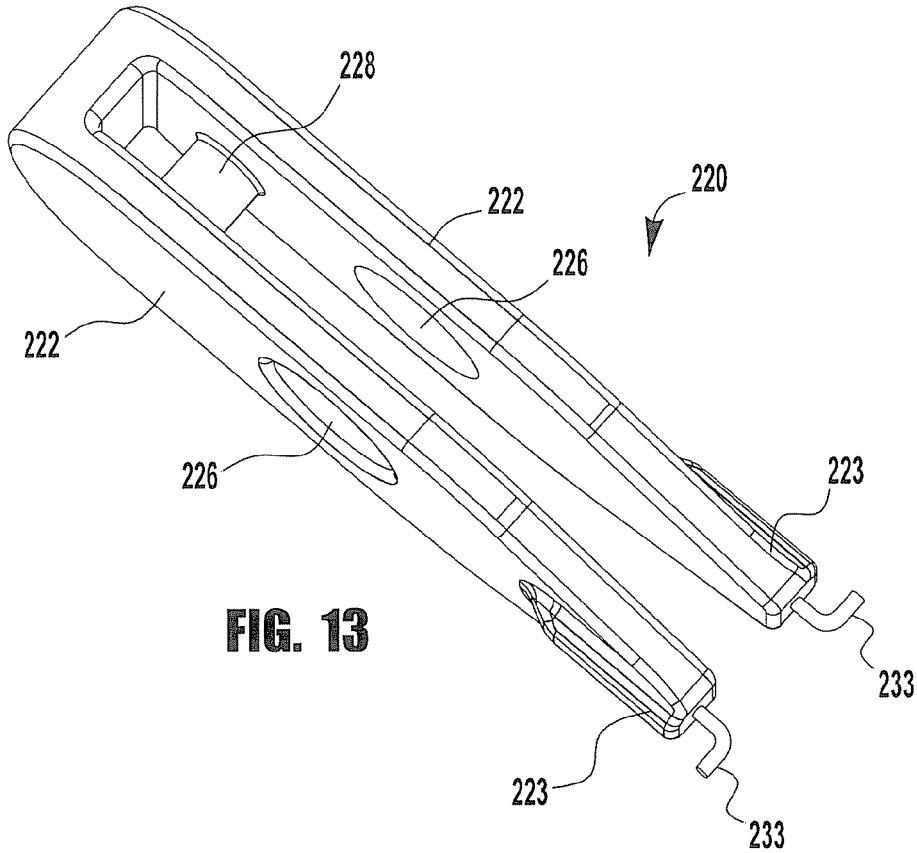
FIG. 13 is an upper perspective view of the body and pin assembly of the switch lockout device of FIG. 9.

While the cam member 210 may be connected with the body 220 using many different configurations, in the illustrated embodiment, the cam member 210 includes a hinge portion 218 (see FIG. 14) that snaps onto and pivots around a corresponding rod 228 (see FIG. 13) of the body 220. As shown, the cam member 210 may also include finger pads 217, 219 on upper and lower ends of the cam member to facilitate user movement of the cam member 210 between locking and unlocked positions.

Figure 15:
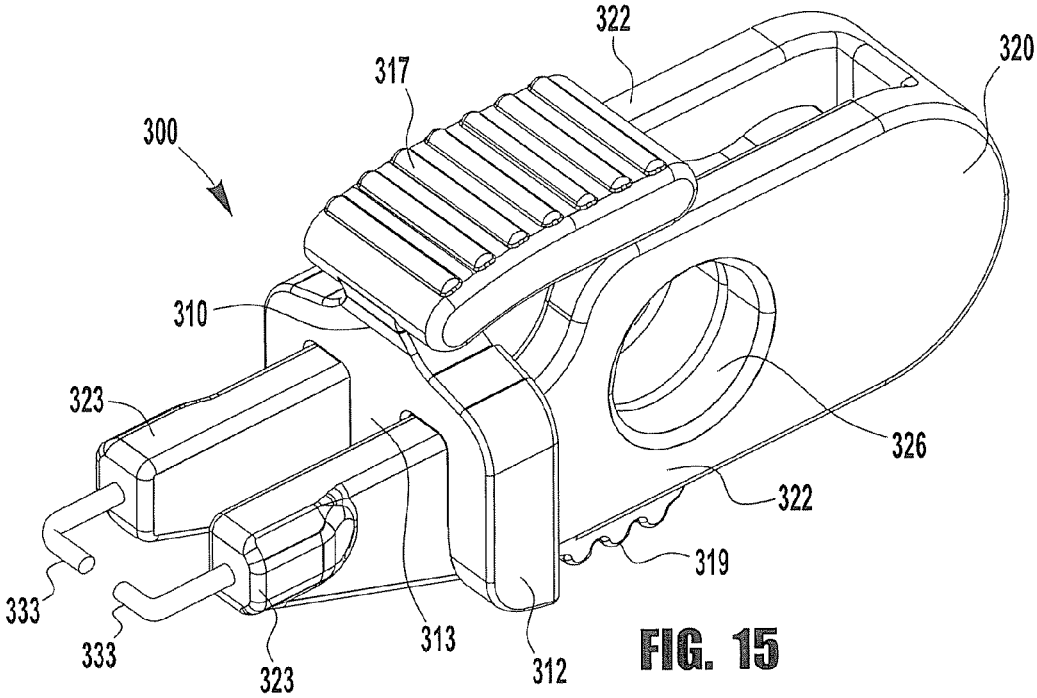
FIG. 15 is a perspective view of another switch lockout device, shown in a locking position.

In another embodiment, a lockout device may include laterally inward oriented pills and a cam member configured to force the pins towards each other and into a hole engaging position when the cam member is in a locking condition. FIG. 15 illustrates one such lockout device 300 having a cam member 310 assembled between side walls 322 of a body 320 and pivotable between a locking position and an unlocked position. Laterally inward extending pins 333 extend from end portions 323 of side walls 322. The cam member 310 includes outer side camming portions or flanges 312 that hold the pins 333 in a laterally inward hole engaging position when the cam member 310 is in the locking position. The cam member 310 may (but need not) further include a central blocking portion 313 that is disposed between the side walls 322 when the cam member 310 when the cam member is in a locking position, thereby preventing further inward movement of the side walls 322 and pins 333. While the camming portions 312 may apply inward camming forces directly to the pins 333, in the embodiment of FIG. 15, the camming portions 312 engage the body side walls 322, preventing the side walls from flexing outward, thereby retaining the pills 333 in the hole engaging position. In this position, a lock opening 316 in the cam member 310 aligns with lock openings 326 in the side walls 322 of the body 320, such that insertion of a lock member (not shown) secures the cam member 310 in the locking position.

Figure 16:
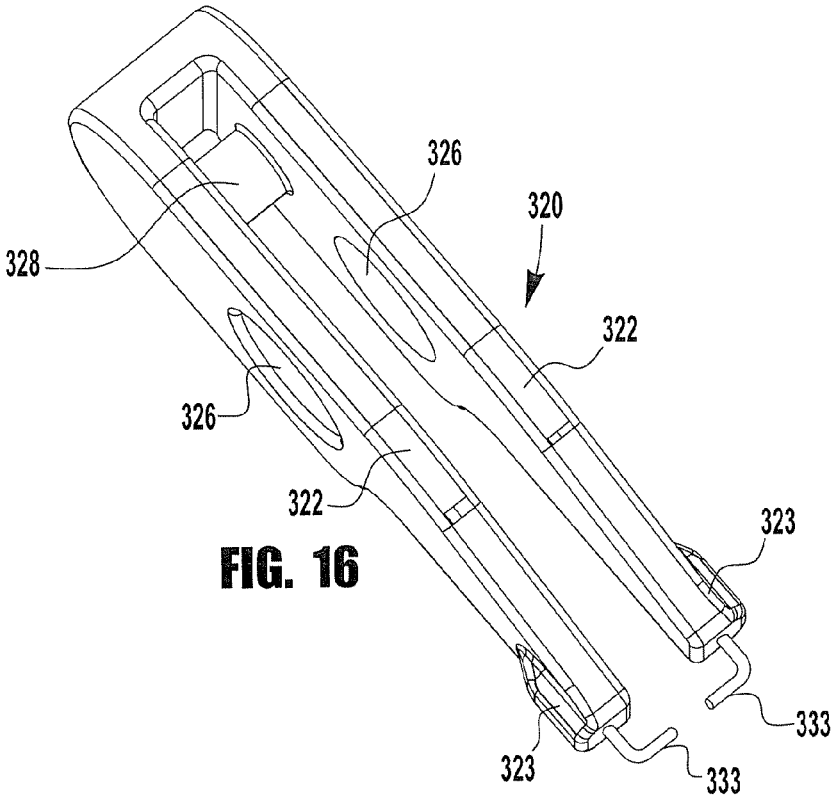
FIG. 16 is an upper perspective view of the body and pin assembly of the switch lockout device of FIG. 15.
Figure 17:
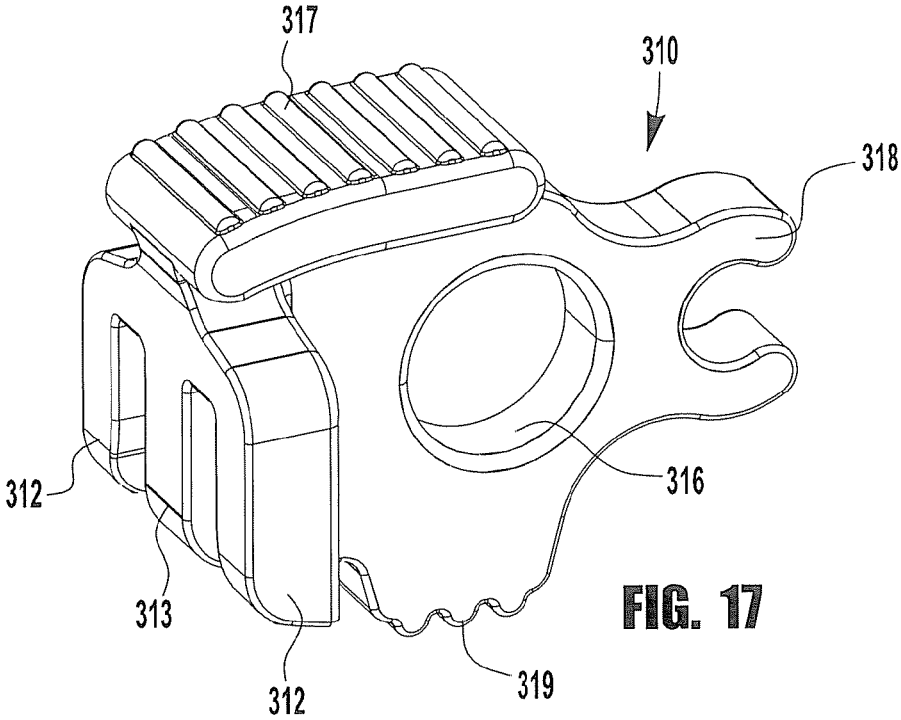
FIG. 17 is a side perspective view of the cam lever of the switch lockout device of FIG. 15.

As with the embodiment of FIGS. 9-12, the exemplary cam member 310 includes a hinge portion 318 (see FIG. 17) that snaps onto and pivots around a corresponding rod 328 (see FIG. 16) of the body 220. Also, the cam member 310 may (but need not) also include finger pads 317, 319 on upper and lower ends of the cam member to facilitate user movement of the cam member 310 between locking and unlocked positions.

While the cam members of the lockout devices of FIGS. 4-8, 9-12, and 15 are pivotable about an axis substantially parallel to the locking pins, in other embodiments, cam members may be configured to pivot in different directions. In one embodiment, a cam member may be pivotable or rotatable about an axis substantially perpendicular to the laterally extending locking pins, wherein rotation of the cam member engages the pins to force and/or hold the pins in a side wall hole engaging position.

Figure 18:
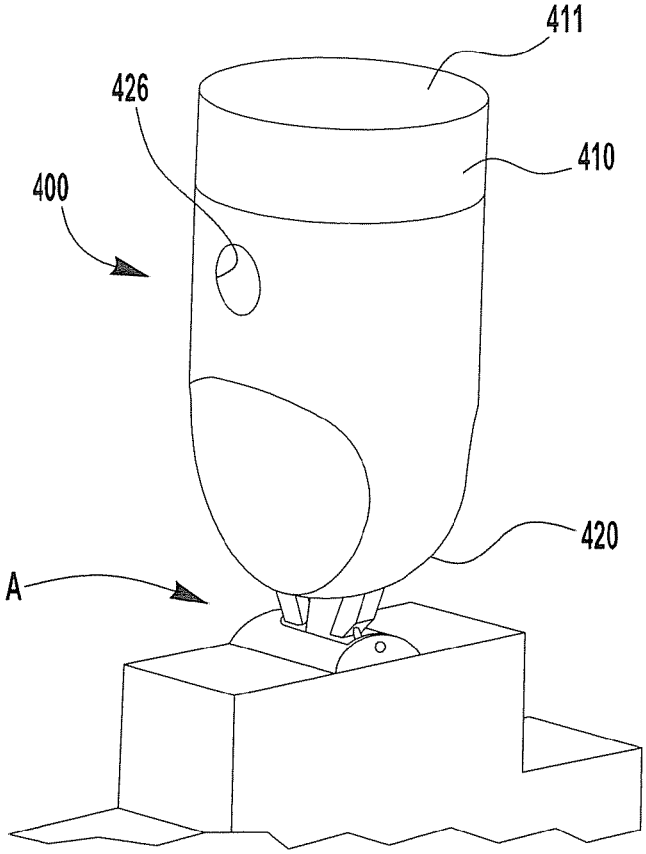
FIG. 18 is a perspective view of yet another switch lockout device, shown assembled with a switch assembly.
Figure 19:
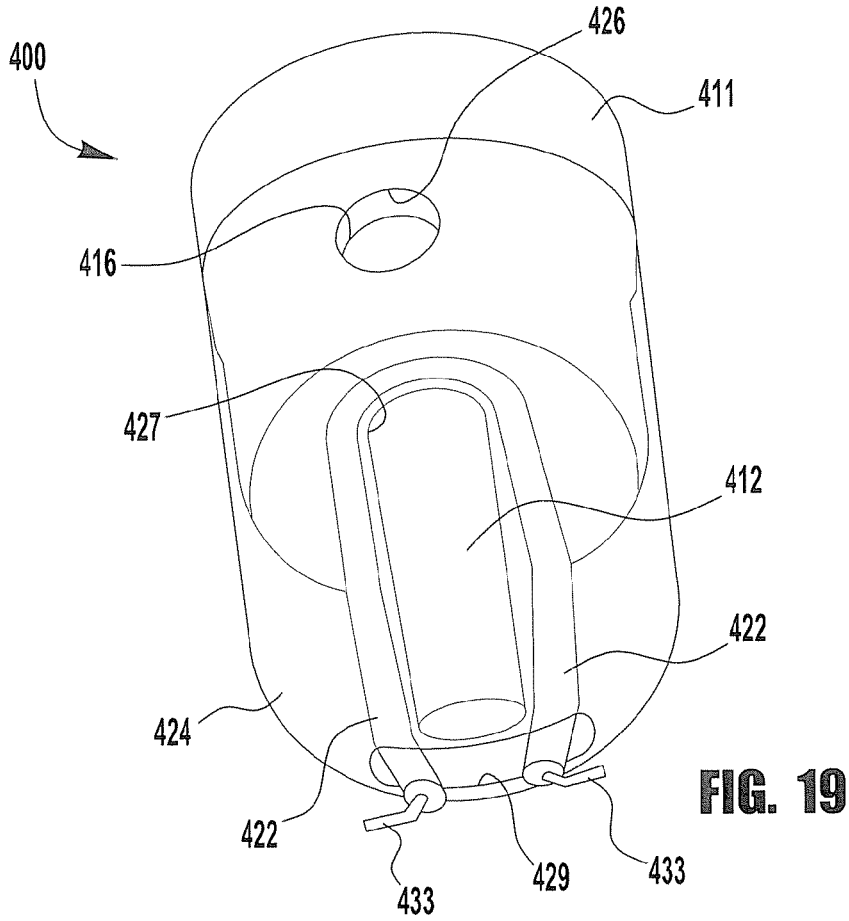
FIG. 19 is a lower side perspective view of the switch lockout device of FIG. 18, with the case portion shown in phantom to illustrate the sleeve and pin assembly.
Figure 21:
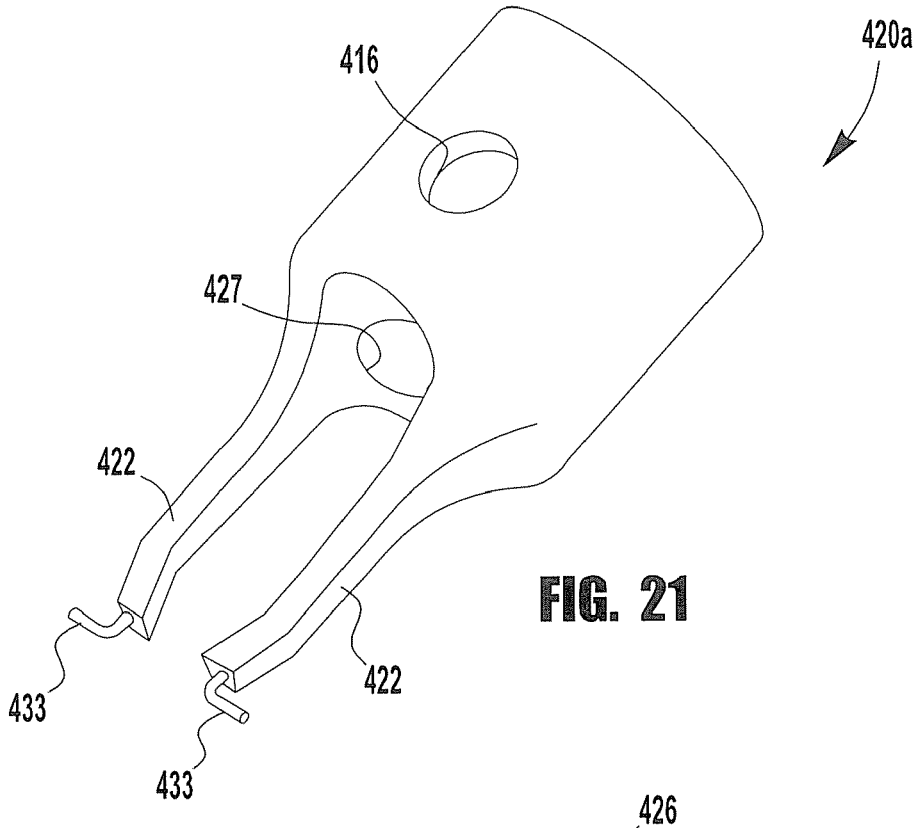
FIG. 21 is a perspective view of the sleeve portion of the switch lockout device of FIG. 18.
Figure 22:
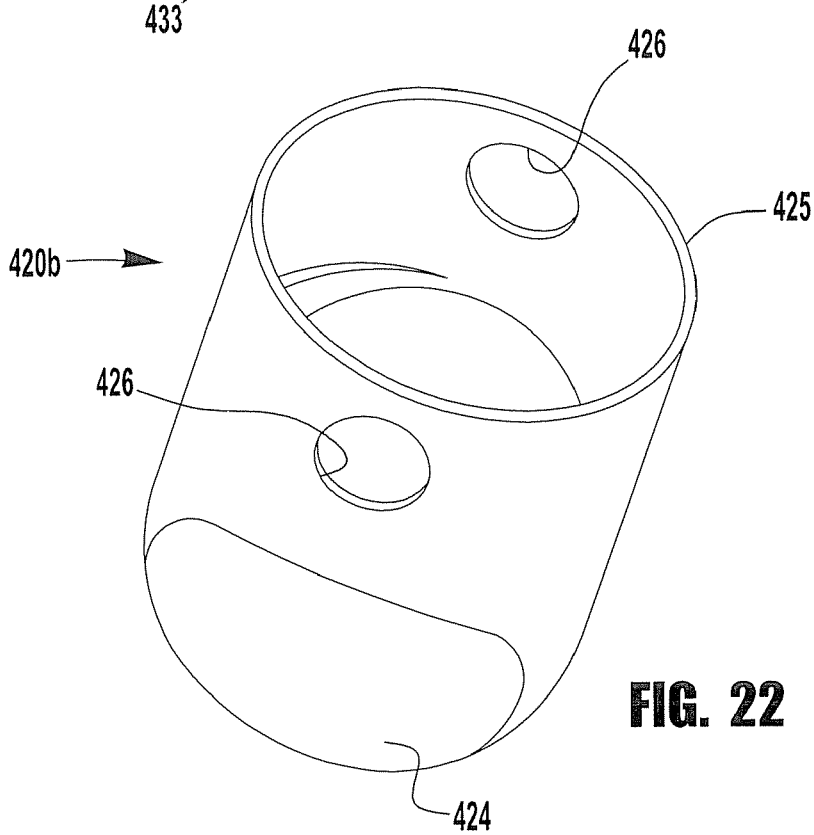
FIG. 22 is a perspective view of the case portion of the switch lockout device of FIG. 18.

FIGS. 18 and 19 illustrate a lockout device 400 having a cam member 410 assembled with a body 420. The body 420 includes a sleeve portion 420*a* (see FIG. 21) having first and second prongs 422 from which first and second pins 433 extend. The body further includes a case portion 420*b* (see FIG. 22) which surrounds the sleeve portion 420*a* to restrict access to the prongs 422, with an opening in the base 424 of the case portion 420*b* for the pins 433 to extend through. The sleeve and case portions 420*a*, 420*b* may be rotationally fixed to each other. As shown, the pins 433 may be resiliently biased inward toward a hole disengaging position.

Figure 20:
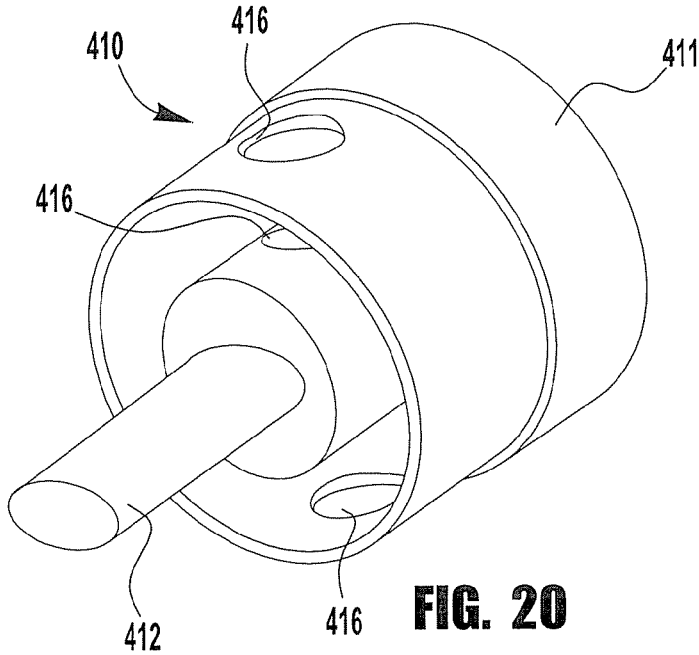
FIG. 20 is a lower perspective view of the cam member of the switch lockout device of FIG. 18.

As more clearly shown in FIG. 20, the cam member 410 includes a user rotatable cap portion 411 surrounding a central bayonet-type camming portion 412 having an elliptical, oblong, or flattened cross section. The cap portion 411 is assembled with an open upper end 425 of the case portion 420*b*, and the camming portion is received through a central opening 427 of the sleeve portion 420*a*, as shown in FIG. 19. When the cam member 410 is rotated to a locking position, the camming portion 412 forces the prongs 422 and pins 433 laterally outward, such that the pins 433 are in a hole engaging position. In this locking position, lock openings 416 in the cam member 410 align with corresponding lock openings 426 in the body 420, such that insertion of a lock member (for example, a padlock shackle) through the aligned lock openings 416, 426 secures the cam member 410 in the locking position. When the cam member 410 is rotated to an unlocked position (for example, after a lock member has been removed from the lock openings 416, 426), the prongs 422 and pins 433 are permitted to spring or bias inward into the hole disengaging position, thereby permitting removal of the lockout device 400 from the switch assembly A.

In another embodiment (not shown) similar to the embodiment of FIGS. 18 and 19, the pins may be oriented laterally inward and the case portion may be rotatable with respect to the sleeve portion, such that the case portion functions as a cam member. The case portion would include contoured camming walls that force the outwardly biased pins inward and into a hole engaging position when the case portion is rotated to a locking position.

While the cam members of the lockout devices of FIGS. 4-8, 9-12, 15, and 18-19 engage locking pins to force them into a hole engaging or locking condition, in other embodiments, a cam member may be configured to engage one or more locking pins to force the pins into a hole disengaging or unlocked condition. In such an embodiment, a locking arrangement may be utilized to prevent engagement between the cam member and the pins, thereby maintaining the pins in a hole engaging or locking condition. In one embodiment, a cam member may be assembled with a body of a lockout device such that the cam member is pivotable from a pin disengaging or locking position to a pin engaging or unlocked position.

Figure 23:
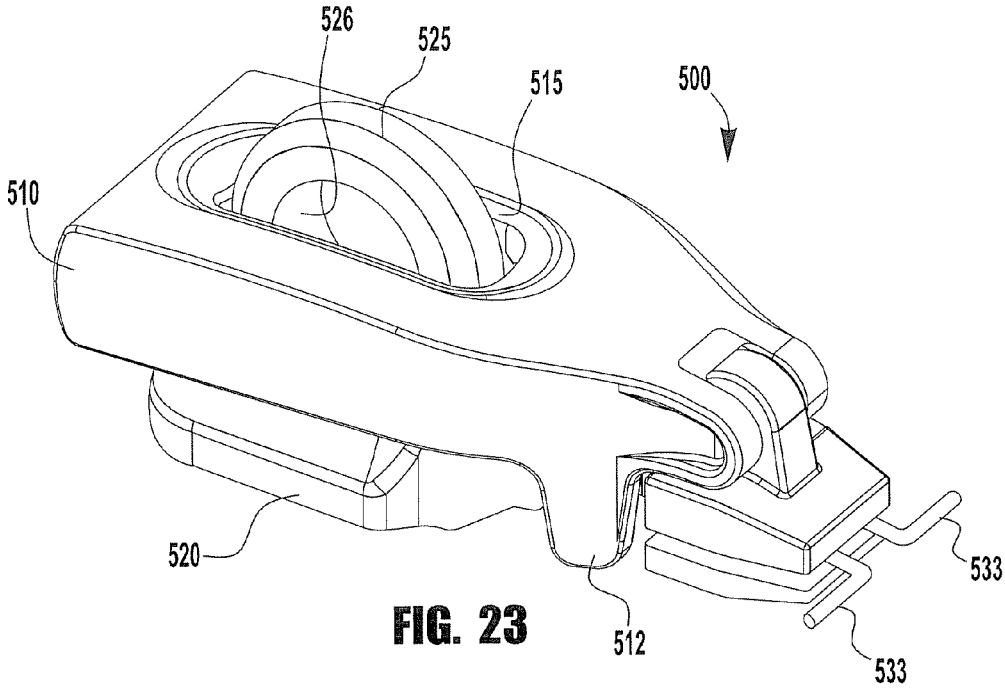
FIG. 23 is a perspective view of another switch lockout device, shown in an unlocked position.
Figure 24:
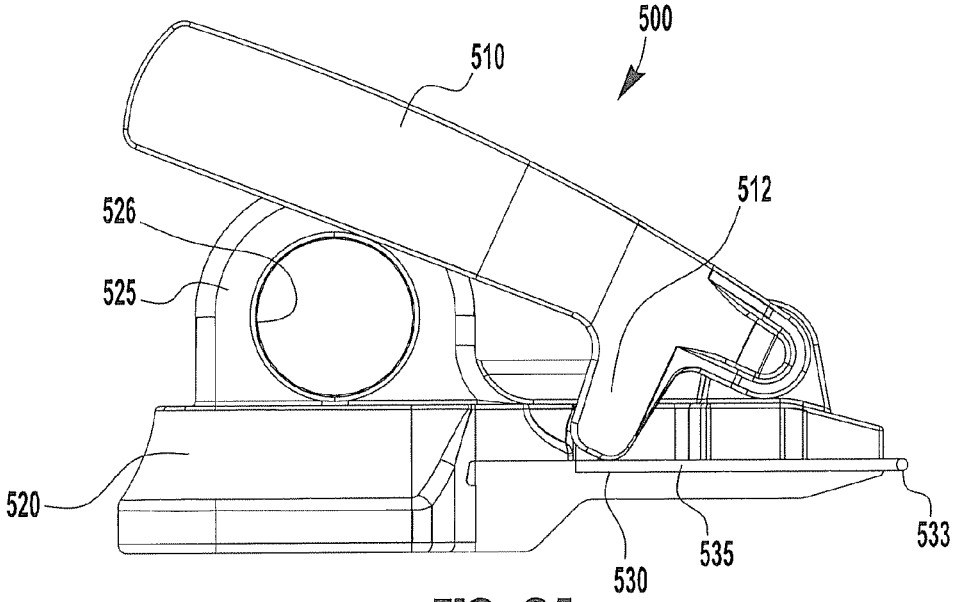
FIG. 24 is a side view of the switch lockout device of FIG. 23.

FIGS. 23 and 24 illustrate an exemplary lockout device 500 having a pivotable cam member or lever 510 assembled with a body 520 and configured to be pivotable between a locking or pin disengaging position (FIG. 24) and an unlocked or pin engaging position (FIG. 23). The cam member 510 includes a camming portion or flanges 512. In the unlocked position, the flanges 512 engage outwardly biased side portions 535 of a spring member 530 (which may be similar to the spring member 130 of FIG. 5) retained within the body 520 to force the laterally extending pins 533 inward and out of engagement with the side wall holes of a switch assembly (for example, the switch assembly A of FIG. 1) when the lockout device 500 is aligned with the switch assembly.

While many different locking arrangements may be used to prevent the cam member 510 from being pivoted to the locking position, in the illustrated embodiment, a hasp portion 525 defining a lock opening 526 extends from the body 520 to be received through a corresponding opening or slot 515 in the cam member 510. Insertion of a lock member (for example, a padlock shackle, not shown) through the lock opening 526 prevents insertion of the hasp 525 through the slot 515, thereby retaining the pins 533 in the hole engaging position. To remove the lockout device 500 from the associated switch assembly, the lock member is removed from the lock opening 526 to allow the cam member 510 to be pressed into the unlocked position.

Figure 25:
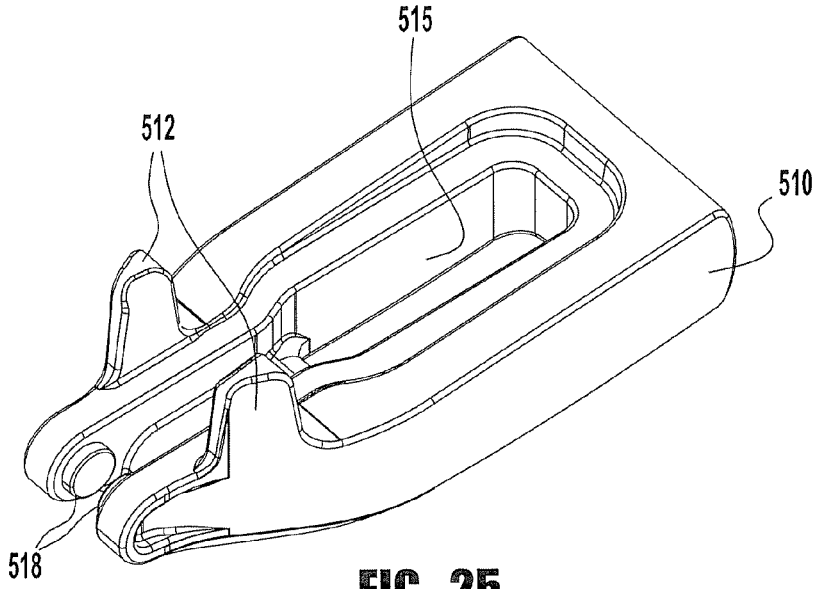
FIG. 25 is a bottom perspective view of the biasing lever of the switch lockout device of FIG. 23.

While the cam member 510 may be connected with the body 520 using many different configurations, in the illustrated embodiment, the illustrated cam member 510 includes opposed nubs 518 (see FIG. 25) that snap into and pivot within a corresponding hole (which may be similar to the hole 128 shown in FIG. 5) of the body 520.

According to another inventive aspect of the present application, a lockout device may be configured such that a lock member may be inserted into or through the lockout device to function as a cam member, thereby holding the locking pins in a hole engaging or locking condition. In one embodiment, a body of a lockout device may include one or more lock openings positioned such that insertion of a lock member through the lock openings obstructs movement of one or more pin components into a hole disengaging or unlocked condition.

Figure 26:
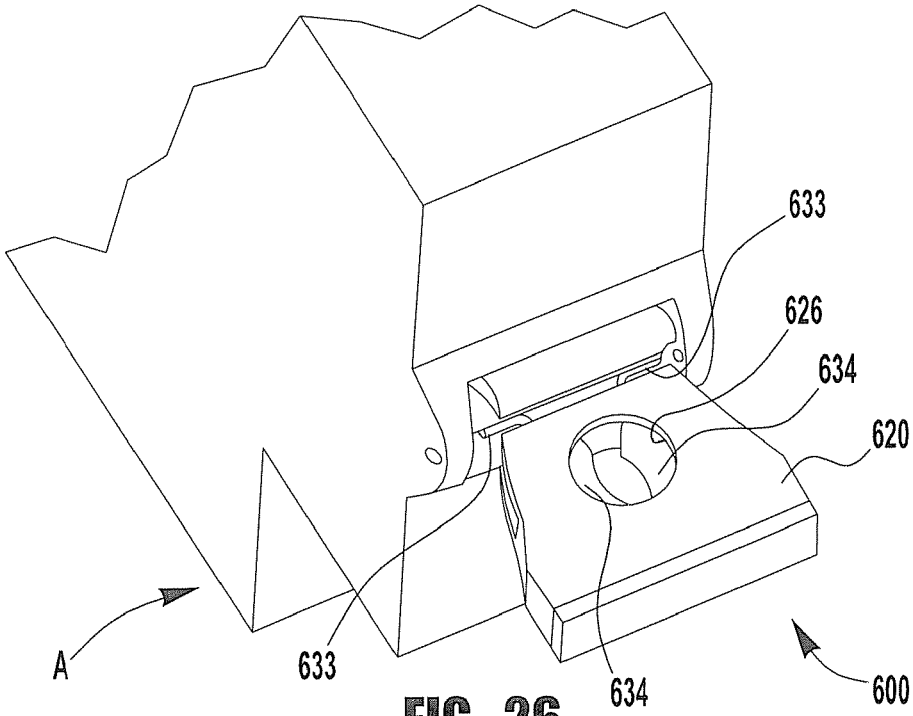
FIG. 26 is a perspective view of another switch lockout device, shown assembled with a switch assembly.
Figure 27:
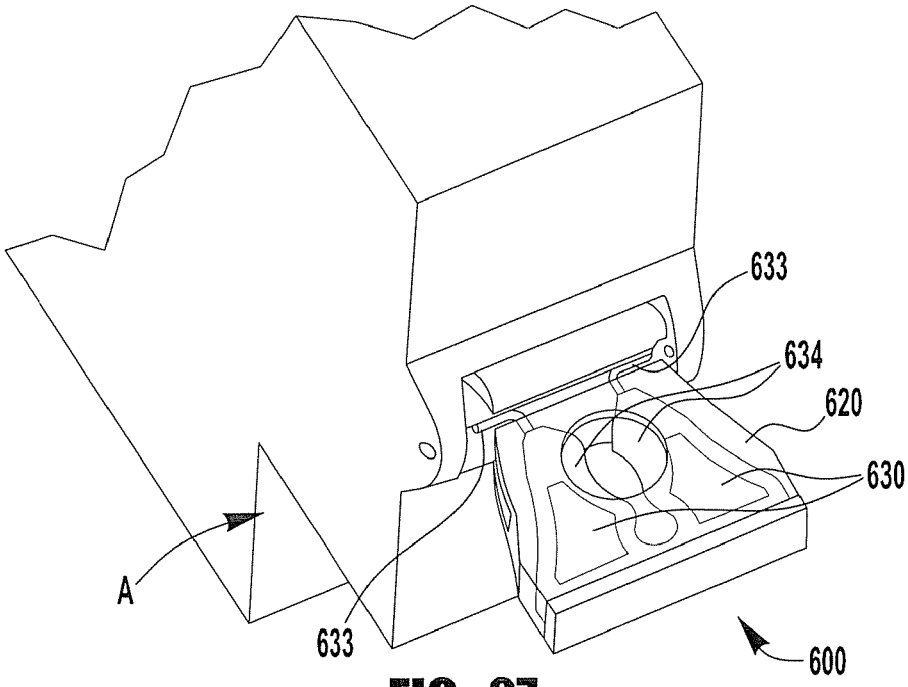
FIG. 27 is a perspective view of the switch lockout device of FIG. 26, with the housing body shown in phantom to illustrate the locking pin assembly.

FIGS. 26 and 27 illustrate a lockout device 600 having a body 620 that retains opposed spring members 630 (which may but need not be disposed on a single, U-shaped component, as more clearly shown in FIG. 27), from which locking pins 633 laterally extend beyond an end of the body 620. The body includes lock openings 626 positioned such that a lock member (not shown) inserted through the lock openings 626 passes between the spring members 630. As shown, the spring members 630 may include contoured lock member engaging portions 634 that extend into the lock openings 626. When a lock member is inserted into the lock openings 626, the lock member engages the contoured portions 634 and forces the spring members 630 and pins 633 laterally outward and into a hole engaging or locking condition. The spring members 630 may (but need not) be resiliently biased inward, such that when the lock member is withdrawn from the lock openings 626, the spring members 630 and pins 633 automatically spring inward into a hole disengaging or unlocked condition.

Figure 28:
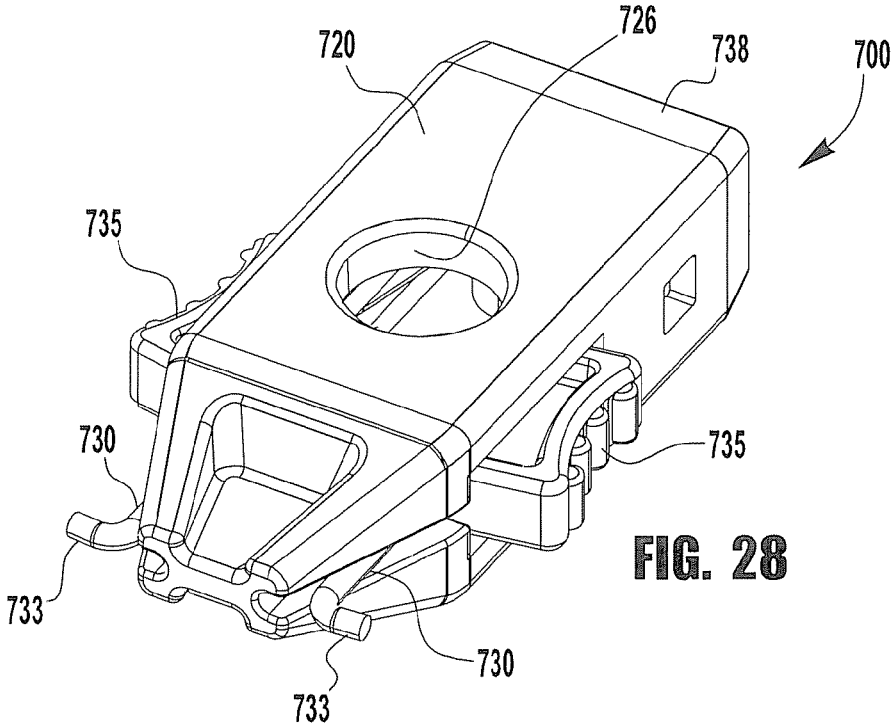
FIG. 28 is a front perspective view of another switch lockout device, shown in a locking position.
Figure 29:
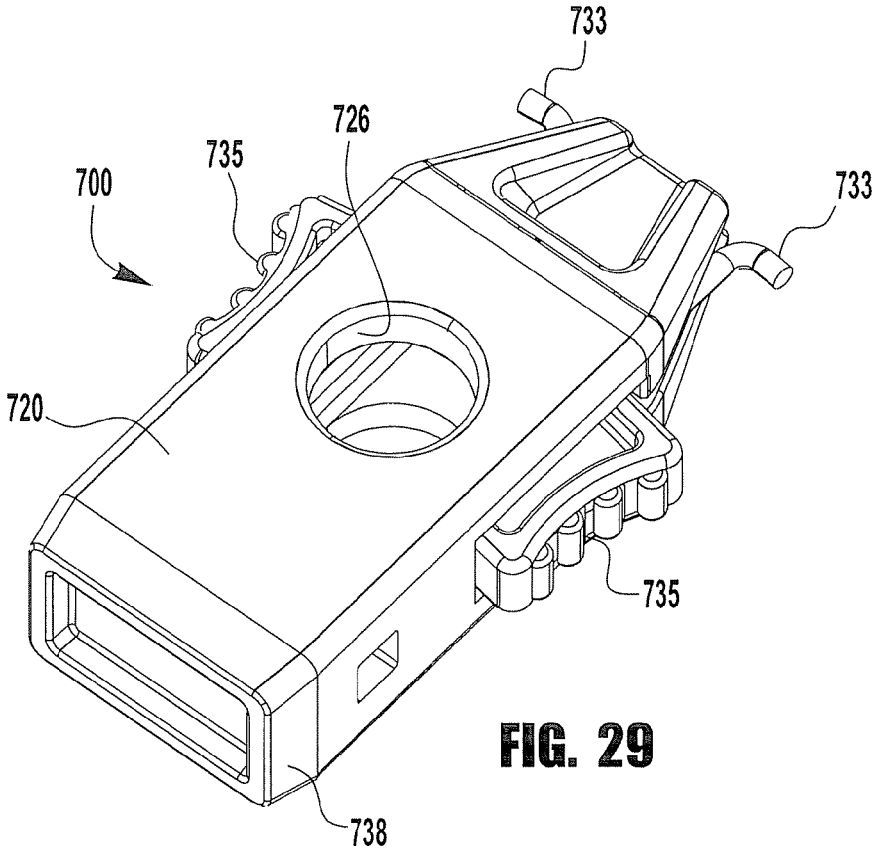
FIG. 29 is a rear perspective view of the switch lockout device of FIG. 28.
Figure 30:
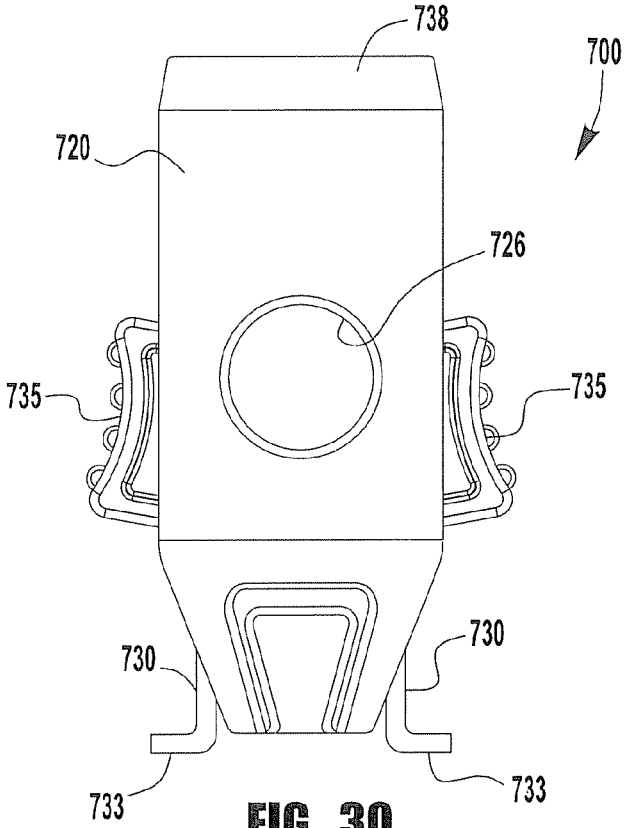
FIG. 30 is a top view of the switch lockout device of FIG. 28.

In another embodiment, insertion of a lock member through a lock opening in a lockout device prevents user movement of the locking pins from the hole engaging condition to the hole disengaging position. FIGS. 28-30 illustrate a lockout device 700 having a body 720 that retains spring members 730 (which may but need not be disposed on a single, U-shaped component), from which locking pins 733 laterally extend at an end of the body 720. The spring members 730 and pins 733 may be resiliently biased outward toward a hole engaging or locking condition. While the lockout device may be configured such that a user directly squeezed the spring members 730 to move the pins 733 out of engagement with the side wall holes of the switch assembly, in the illustrated embodiment, finger pads 735 are assembled with the spring members 730 to facilitate user manipulation of the pins 733. The body 720 includes lock openings 726 positioned such that a lock member (not shown) inserted through the lock openings 726 passes between the spring members 730. When a lock member is inserted into the lock openings 726, the lock member prevents user movement of the spring members 730 and pins 733 out of the hole engaging position. When the lock member is withdrawn from the lock openings 726, the user may squeeze the finger pads 735 to withdraw the pins 733 from the side wall holes.

Figure 31:
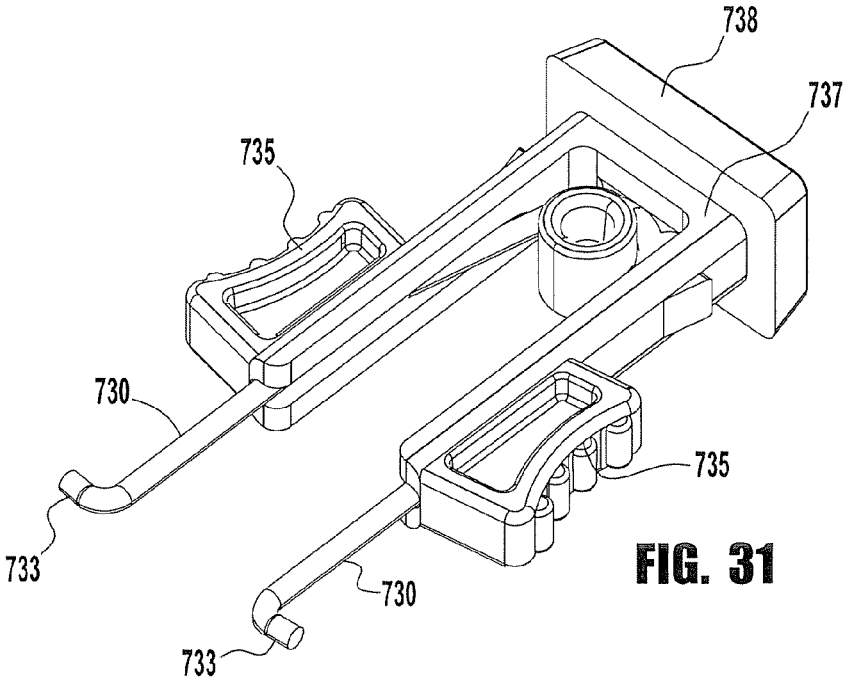
FIG. 31 is a perspective view of a locking pin and finger pad assembly for the switch lockout device of FIG. 28.
Figure 32:
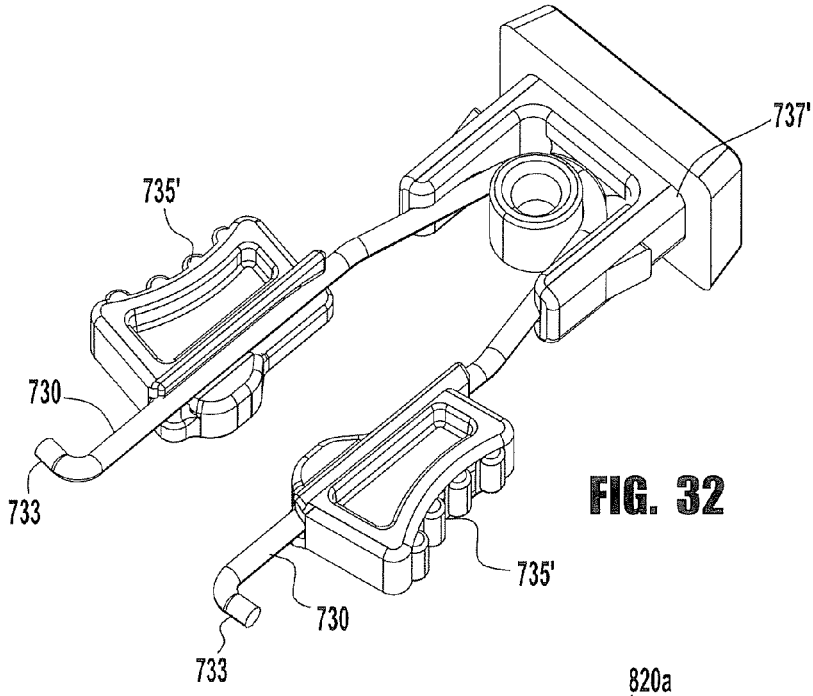
FIG. 32 is a perspective view of another locking pin and finger pad assembly for use with the switch lockout device of FIG. 28.

To retain the spring members 730 within the body 720, a spring retainer 737, 737' may be utilized, as shown in FIGS. 31 and 32. As shown, the spring retainer 737, 737' may include an end portion 738 which encloses an end of the body 720. The finger pads 735, 735' may be integral to the spring retainer 737, as shown in FIG. 31, or separate from the spring retainer 737', as shown in FIG. 32.

Figure 33:
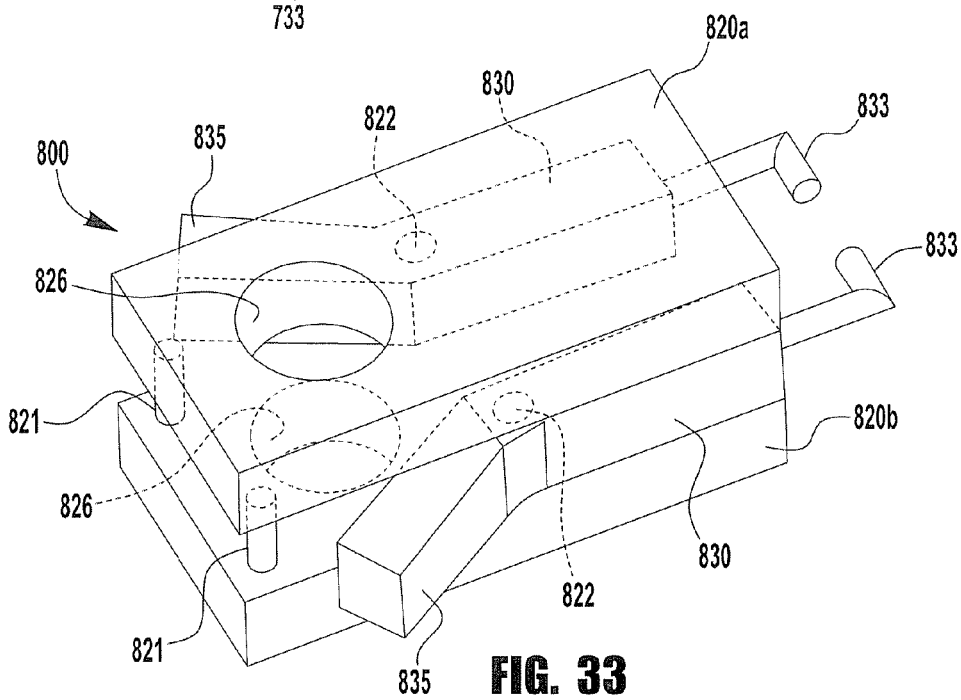
FIG. 33 is a perspective view of still another switch lockout device, shown in a locking position.

Many different types of user manipulation may be utilized to move locking pins out of engagement with side wall holes of a switch assembly, and may consequently be blocked by the insertion of a lock member. In one embodiment, opposed levers may be pressed or squeezed to pivot inwardly oriented locking pins laterally outward and out of engagement with the side wall holes. A lock opening may be positioned such that insertion of a lock member through the lock opening prevents such user operation of the levers. In the embodiment of FIG. 33, a lockout device 800 includes a body 820 having two parallel spaced plates 820*a*, 820*b* separated by spacer pins 821 and pivot pins 822. Levers 830 are assembled between the plates 820*a*, 820*b* on the pivot pins 822. Outward angled ends 835 of the levers 830 extend laterally outward from the sides of the body 820. The levers 830 may (but need not) be resiliently or spring biased such that locking pins 833 extending from the levers 830 are biased towards a hole engaging or locking condition. When a user presses or squeezes the lever ends 835, the levers 830 pivot to move the pins 833 laterally outward and into a hole disengaging position. The body plates 820*a*, 820*b* include lock openings 826 positioned such that a lock member (not shown) inserted through the lock openings 826 passes between the levers 830. When a lock member is inserted into the lock openings 826, the lock member prevents user movement of the levers 830 and pins 833 out of the hole engaging position. When the lock member is withdrawn from the lock openings 826, the user may squeeze the lever ends 835 to withdraw the pins 833 from the side wall holes.

While various inventive aspects, concepts and features of the inventions may be described and illustrated herein as embodied in combination in the exemplary embodiments, these various aspects, concepts and features may be used in many alternative embodiments, either individually or in various combinations and sub-combinations thereof. Unless expressly excluded herein all such combinations and sub-combinations are intended to be within the scope of the present inventions. Still further, while various alternative embodiments as to the various aspects, concepts and features of the inventions—such as alternative materials, structures, configurations, methods, circuits, devices and components, software, hardware, control logic, alternatives as to form, fit and function, and so on—may be described herein, such descriptions are not intended to be a complete or exhaustive list of available alternative embodiments, whether presently known or later developed. Those skilled in the art may readily adopt one or more of the inventive aspects, concepts or features into additional embodiments and uses within the scope of the present inventions even if such embodiments are not expressly disclosed herein. Additionally, even though some features, concepts or aspects of the inventions may be described herein as being a preferred arrangement or method, such description is not intended to suggest that such feature is required or necessary unless expressly so stated. Still further, exemplary or representative values and ranges may be included to assist in understanding the present disclosure; however, such values and ranges are not to be construed in a limiting sense and are intended to be critical values or ranges only if so expressly stated. Moreover, while various aspects, features and concepts may be expressly identified herein as being inventive or forming part of an invention, such identification is not intended to be exclusive, but rather there may be inventive aspects, concepts and features that are fully described herein without being expressly identified as such or as part of a specific invention. Descriptions of exemplary methods or processes are not limited to inclusion of all steps as being required in all cases, nor is the order that the steps are presented to be construed as required or necessary unless expressly so stated.

I claim:

1. A lockout device for a switch assembly having a switch moveable between first and second switching positions, the switch being laterally disposed between side walls each having a hole formed therein, the lockout device comprising:

a body;

first and second laterally extending pins assembled with the body such that the first and second laterally extending pins are laterally movable between a hole engaging position and a hole disengaging position; and a cam member assembled with the body and pivotable with respect to the body between a locking position and an unlocked position;

wherein when the cam member is in the locking position, the cam member holds the first and second pins in the hole engaging position;

further wherein when the cam member is in the unlocked position, the first and second pins are movable from the hole engaging position to the hole disengaging position;

further wherein the body defines a lock opening configured to receive a lock member to secure the cam member in the locking position.

2. The lockout device of claim 1, wherein the body comprises a flexible web bendable to move the first and second pins between the hole engaging position and the hole disengaging position.

3. The lockout device of claim 1, wherein the cam member defines a second lock opening configured to align with the first stated lock opening when the cam member is in the locking position.

4. The lockout device of claim 1, wherein the cam member is pivotable about an axis substantially parallel to the first and second laterally extending pins.

5. The lockout device of claim 1, wherein the cam member is pivotable about an axis substantially perpendicular to the first and second laterally extending pins.

6. The lockout device of claim 1, wherein the first and second laterally extending pins face laterally outward.

7. The lockout device of claim 1, wherein the first and second laterally extending pins face laterally inward.

8. The lockout device of claim 1, wherein the cam member when in the locking position limits laterally inward movement of the first and second laterally extending pins.

9. The lockout device of claim 1, wherein the cam member when in the locking position limits laterally outward movement of the first and second laterally extending pins.

10. The lockout device of claim 1, wherein the first and second pins are laterally outwardly biased.

11. The lockout device of claim 1, wherein the first and second pins are laterally inwardly biased.

12. The lockout device of claim 1, wherein the first and second pins are disposed on opposite ends of a spring member.

13. A lockout device for a switch assembly having a switch moveable between first and second switching positions, the switch being laterally disposed between side walls each having a hole formed therein, the lockout device comprising:

a body having first and second lateral sides terminating at a first end, the body further including upper and lower walls disposed between the first and second lateral sides;

first and second levers assembled with the body such that a user graspable portion of each of the first and second levers extends through the corresponding first and second lateral sides of the body, the first and second levers being manually movable with respect to the body from a laterally outward position to a laterally inward position; and first and second pins connected with the corresponding first and second levers, the first and second pins extending laterally outward of the first and second sides of the body at the first end for engagement with the holes of the switch assembly side walls when the first and second levers are in the laterally outward position;

wherein the upper and lower walls define a lock opening configured to receive a lock member therethrough, thereby obstructing movement of the first and second levers to the laterally inward position such that the first and second pins are secured in engagement with the holes of the switch assembly side walls.

14. The lockout device of claim 13, wherein the first and second sides of the body include corresponding first and second access openings configured to permit user access to the first and second levers.

15. The lockout device of claim 14, wherein the first and second levers comprise corresponding first and second finger pads extending laterally outward from the corresponding first and second access openings.

16. The lockout device of claim 13, wherein the first and second levers are laterally outwardly biased.

17. The lockout device of claim 13, wherein the first and second pins and first and second levers are disposed on corresponding first and second sides of a U-shaped spring member.

18. A method for locking out a switch assembly having a switch moveable between first and second switching positions, the switch being laterally disposed between side walls each having a hole formed therein, the method comprising:

providing a body with first and second laterally extending pins assembled with the body;

inserting the first and second laterally extending pins through the holes in the switch assembly side walls;

pivoting a cam member assembled with the body to a locking position to secure the first and second pins in the holes in the switch assembly side walls; and securing a lock member in a lock opening provided in the body to secure the cam member in the locking position.

19. The method of claim 18, wherein pivoting the cam member assembled with the body to the locking position comprises pivoting the cam member about an axis substantially parallel to the first and second laterally extending pins.

20. The method of claim 18, wherein pivoting the cam member assembled with the body to the locking position comprises receiving the lock opening through a corresponding slot in the cam member.

21. A lockout device for a switch assembly having a switch moveable between first and second switching positions, the switch being laterally disposed between side walls each having a hole formed therein, the lockout device comprising:

a body;

first and second laterally extending pins assembled with the body such that the first and second laterally extending pins are laterally movable between a hole engaging position and a hole disengaging position; and a cam member assembled with the body and pivotable with respect to the body between a locking position and an unlocked position;

wherein when the cam member is in the unlocked position, the cam member holds the first and second pins in the hole disengaging position;

further wherein the body defines a lock opening configured to receive a lock member to prevent the cam member from being moved to the unlocked position.

* * * * *